US007351100B2

(12) United States Patent
Yodogawa

(10) Patent No.: US 7,351,100 B2
(45) Date of Patent: Apr. 1, 2008

(54) ELECTRIC CONNECTOR

(75) Inventor: Akihiro Yodogawa, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/783,114

(22) Filed: Apr. 5, 2007

(65) Prior Publication Data

US 2007/0238351 A1 Oct. 11, 2007

(30) Foreign Application Priority Data

Apr. 6, 2006 (JP) ..... P. 2006-105542

(51) Int. Cl.
*H01R 9/05* (2006.01)

(52) U.S. Cl. ..... 439/579

(58) Field of Classification Search ..... 439/579, 439/578, 404, 405, 417, 422, 498, 499, 497
See application file for complete search history.

(56) References Cited

U.S. PATENT DOCUMENTS

| | | | | |
|---|---|---|---|---|
| 6,676,444 | B2 * | 1/2004 | Noro | 439/579 |
| 6,793,527 | B2 * | 9/2004 | Noro | 439/579 |
| 6,811,439 | B1 * | 11/2004 | Shin-Ting | 439/607 |
| 6,840,792 | B1 * | 1/2005 | Kuan | 439/404 |
| 6,884,107 | B1 * | 4/2005 | Kuan | 439/404 |
| 6,994,583 | B1 * | 2/2006 | Chi-Te | 439/404 |
| 7,018,238 | B1 * | 3/2006 | Zhi-xuan | 439/607 |
| 7,229,298 | B2 * | 6/2007 | Shen et al. | 439/95 |
| 7,273,390 | B2 * | 9/2007 | Iida et al. | 439/494 |

FOREIGN PATENT DOCUMENTS

| | | |
|---|---|---|
| JP | 11-345640 | 12/1999 |

* cited by examiner

*Primary Examiner*—Alexander Gilman
(74) *Attorney, Agent, or Firm*—Morgan, Lewis & Bockius LLP

(57) ABSTRACT

A plug member is adapted to be fitted into a socket member in a first direction. The plug member includes: a plug body, formed with a plug groove extending in a second direction perpendicular to the first direction; and plug contacts each having a blade portion. A pressing member includes a first part extending in the first direction, and a second part extending in a third direction orthogonal to the first direction and the second direction. Each of sheathed wires includes a conductive core wire and an insulative first sheath covering the core wire. A tip end portion of the first part of the pressing member is formed with first grooves arranged in the second direction. One end of the second part of the pressing member is formed with second grooves arranged in the second direction. The first part of the pressing member is inserted into the plug groove under a condition that first portions of the sheathed wires are respectively clamped by the first grooves and second portions of the sheathed wires are respectively clamped by the second grooves. The first part of the pressing member presses the sheathed wires against the plug contacts in the third direction when the first part of the pressing member is inserted into the plug groove, so that the blade portion bites into the core wire in associated one of the sheathed wires.

3 Claims, 24 Drawing Sheets

ELECTRIC CONNECTOR

BACKGROUND

The present invention relates to an electric connector suitable for electrically connecting sheathed wires to a circuit board or the like.

Sheathed wires, each having a core wire covered with an insulating sheath, have been extensively used as wiring members in electronic equipments. In Japanese Patent Publication No. 11-345640A, there is proposed a configuration for connecting such sheathed wires, in which an electric connector electrically connects a plurality of sheathed wires in a press-contact manner collectively without the use of solder.

In the configuration disclosed in the above publication, a lid-shaped pressing member is pivotably supported on a housing. This pressing member has a pressing portion adapted to collectively press blade portions of contacts against sheathed wires inserted into an opening formed at one side of the housing, so that the respective sheathed wires can be electrically connected with the corresponding contacts at once, and efficiency in the connection process can be enhanced.

In electronic equipments which have been more and more advanced with respect to a compact design and a high-density design, it has now been required to achieve a space-saving design with respect to an area of mounting of an electric connector used for connecting the sheathed wires to a circuit board such as a printed circuit board, that is, to save the connector mounting area on the circuit board. Therefore, it is desired that the electric connector should be of such a form as to meet this requirement and also to enhance the connecting reliability.

The electric connector comprises a plug member to which the sheathed wires are electrically connected and a socket member mounted on the circuit board. The plug member is fit into the socket member by insertion to provide electric connection. In the configuration disclosed in the above publication, the circuit board is required to provide an empty space for the sheathed wires to be inserted from the side direction in addition to the installation space for the socket member. Therefore, the entire space becomes large, and space reduction is difficult.

One related-art configuration will be explained with reference to FIGS. 21 through 25.

As shown in FIGS. 21 and 24, sheathed wires 10 are arranged side by side with an equal pitch, and their ends are fixed to an arrangement member 12 formed of an insulative resin material by attaching or welding. A pressing member 14 is formed by bending a conductive plate so as to have a vertically-extending portion 14*a* and a laterally-extending portion 14*b* which are perpendicular to each other. A plug body 16 is formed of an insulative resin, and plug contacts 18 are arranged on the plug body 16 with an equal pitch corresponding to the pitch of the sheathed wires 10, thereby forming a plug member 20. The plug body 16 has a groove 16*a* opened in an upper direction so as to allow insertion of the vertically-extending portion 14*a* of the pressing member 14.

As shown in FIG. 22, the plug contact 18 is formed from a conductive plate so as to have a W-shape including first and second U-shape portions 18*a* and 18*b*. A tip portion of one end of the first U-shape portion 18*a* (i.e., the central vertical portion of the W-shape) is provided with a blade portion 18*c* protruded toward the outside of the U-shape (i.e., toward the inside of the second U-shape portion 18*b*).

The plug contact 18 is installed such that: the second U-shape portion 18*b* opposes the groove 16*a*; the blade portion 18*c* is oriented toward the inside of the groove 16*a*; and at least a part of the other end of the first U-shape portion 18*a* and at least a part of the other end of the second U-shape portion 18*b* (i.e., both outer vertical portions of the W-shape) are exposed from the outer face of the plug body 16.

On the other hand, socket contacts 26 are arranged on a socket body 24 formed of an insulative material with an equal pitch corresponding to the pitch of the sheathed wires 10, thereby forming a socket member 22. The socket body 24 is provided with a groove 24*a* so as to allow the plug member to be inserted from the upper direction. As shown in FIG. 25, the socket contact 26 is formed from a conductive plate so as to have a U-shaped portion 26*a* opened in an upper direction and a terminal 26*b* extended to the outside of the socket body 26. The U-shaped portion 26*a* of the socket contact 26 is arranged along the inside wall of the groove 24*a*, so that the socket contacts 26 can be electrically connected to the both outer vertical portions of the W-shaped plug contacts 18 when the plug member 20 is fitted with the socket member 22. The terminal 26*b* of the socket contact 26 is brought into contact with a circuit board 28 when the socket member 22 is mounted on the circuit board 28. The terminal 26*b* is electrically connected to a connection terminal or the like on the circuit board 28 using a soldering or the like.

In such a construction, end portions of the sheathed wires 10 arranged by the arrangement member 12 are first inserted from the upper direction to the groove 16*a* of the plug member 20 having plug contacts 18 attached to the plug body 16, and subsequently, the vertically-extending portion 14*a* of the pressing member 14 is inserted. Then, the end portions of the sheathed wires 10 are interposed between the vertically-extending portion 14*a* of the pressing member 14 and the central vertical portions of the W-shaped plug contacts 18. As shown in FIG. 23, the blade portion 18*c* sticks through the insulative sheaths 10*a* of the ends of sheathed wires 10 and make contact with the core wires 10*b* so that the core wires 10*b* are electrically connected to the plug contacts 18.

With this configuration, since the end portions of the sheathed wires 10 are inserted from the upper direction to the plug member 20, it is sufficient to provide a small space on the circuit board 28 for mounting the socket member 22. In addition, since the sheathed wires 10 are perpendicularly bent by the laterally-extending portion 14*b* of the pressing member 14, the height dimension to mounting the electric connector can be reduced. Furthermore, since the bent portion of the sheathed wires 10 provides large contact friction resistance, the sheathed wires 10 are not easily removed even when an external force is exerted to the sheathed wires 10 in a pull-out direction.

However, the arrangement work using the arrangement member 12 is necessary to arrange the sheathed wires 10 side by side with an equal interval.

SUMMARY

It is therefore one advantageous aspect of the invention to provide an electric connector in which the arrangement work of the sheathed wires is not necessary.

According to one aspect of the invention, there is provided an electric connector, comprising:

a plug member, adapted to be fitted into a socket member in a first direction, the plug member comprising:

a plug body, formed with a plug groove extending in a second direction which is perpendicular to the first direction; and a plurality of plug contacts, each of which includes a first contact piece and a second contact piece which are opposed to each other with a gap therebetween, and a blade portion extended from the first contact piece so as to oppose the second contact piece, the plug contacts being arrayed in the second direction such that the first contact piece is disposed in the plug groove and the second contact piece is disposed on an outer face of a side wall of the plug body to be electrically connected with the socket body;

a pressing member, comprising a first part extending in the first direction, and a second part extending in a third direction which is orthogonal to the first direction and the second direction; and a plurality of sheathed wires, each of which comprises a conductive core wire and an insulative first sheath covering the core wire, wherein:

a tip end portion of the first part of the pressing member is formed with a plurality of first grooves arranged in the second direction;

a first end of the second part of the pressing member is formed with a plurality of second grooves arranged in the second direction;

the first part of the pressing member is inserted into the plug groove under a condition that first portions of the sheathed wires are respectively clamped by the first grooves and second portions of the sheathed wires are respectively clamped by the second grooves;

the first part of the pressing member presses each of the sheathed wires against the first contact piece in the third direction when the first part of the pressing member is inserted into the plug groove, so that the blade portion bites into the core wire in associated one of the sheathed wires; and the second part of the pressing member bents the sheathed wires so as to extend in the third direction when the first part of the pressing member is inserted into the plug groove.

With this configuration, it is not necessary to perform the arrangement work for the sheathed wires which is essential in the related-art electric connector, the working efficiency can be enhanced. In addition, since the arrangement member required in the arrangement work is not necessary, the number of components can be reduced.

Each of the second portions of the sheathed wires may comprise a conductive shield wire covering the first sheath and an insulative second sheath covering the shield wire. Here, edges of the second grooves bite into the shield wire when the second portions of the sheathed wires are respectively clamped by the second grooves. The pressing member is a conductive member, and adapted to be electrically connected to a shield contact provided in the socket member when the plug member is fitted with the socket member.

With this configuration, the shield wire can be easily electrically connected to a ground terminal of a circuit board or the like on which the socket member is mounted through the pressing member and the shield contact.

A second end of the second part of the pressing member may be formed with a plurality of third grooves arranged in the second direction. Here, the first part of the pressing member is inserted into the plug groove under a condition that third portions of the sheathed wires are respectively clamped by the third grooves.

With this configuration, since the position of each sheathed wire is determined in three points, the sheathed wires can be more reliably arranged side by side with a predetermined pitch.

DETAILED DESCRIPTION OF THE EXEMPLARY EMBODIMENTS

Figure 1:
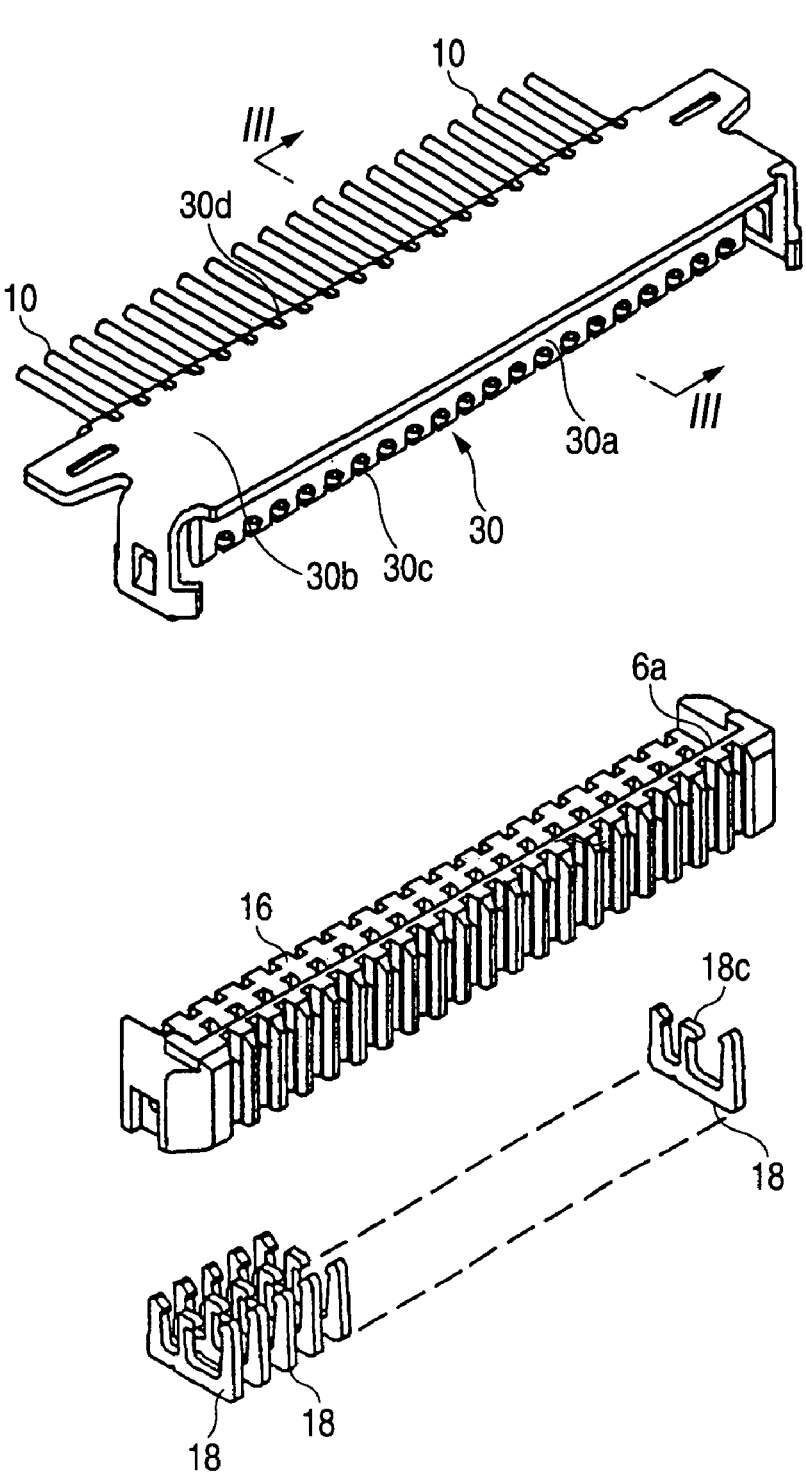
FIG. 1 is a perspective view of a plug member of an electric connector according to a first embodiment, showing a disassembled state.

Exemplary embodiments of the invention will be described below in detail with reference to the accompanying drawings. Components similar to those in the related art shown in FIGS. 21 through 25 will be designated by the same reference numerals, and repetitive explanations for those will be omitted.

Figure 2A:
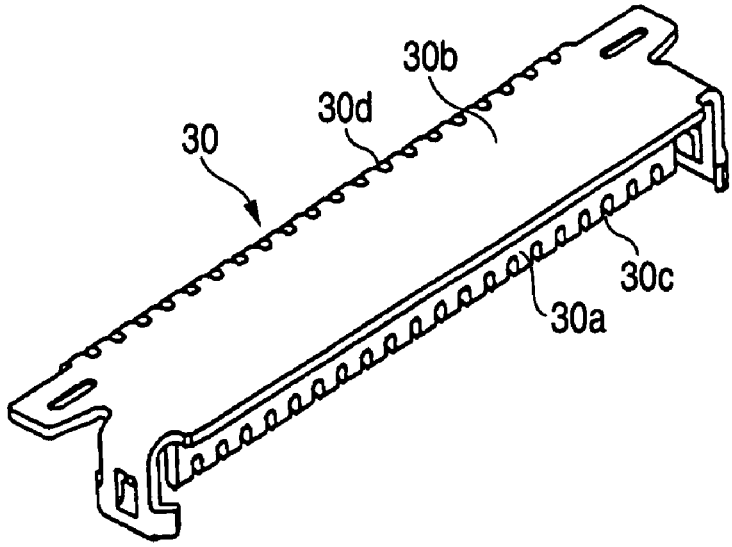
FIG. 2A is a perspective view of a pressing member of the plug member of FIG. 1, viewed from an upper side.
Figure 2B:
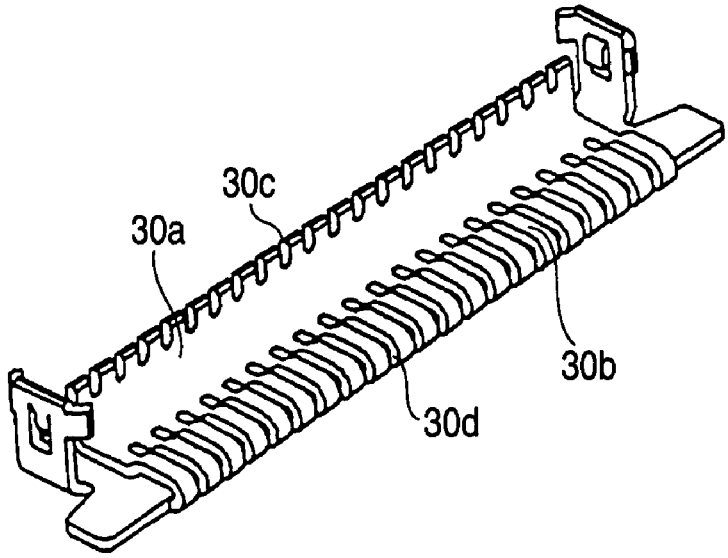
FIG. 2B is a perspective view of the pressing member of FIG. 2A, viewed from a lower side.

In an electric connector according to the first embodiment of the invention, as shown in FIGS. 1 through 2B, a tip end of a vertically-extending portion 30*a* of a pressing member 30 is formed with grooves 30*c* and a laterally-extending portion 30*b* is formed with grooves 30*d*. The grooves 30*c* and 30*d* are so formed as to oppose the plug contacts 18 provided in the plug body 16 when the vertically-extending portion 30*a* is inserted into the groove 16*a* of the plug body 16. The widths of the grooves 30*c* and 30*d* are set such that the sheathed wires 10 can be inserted thereto by slightly deforming the sheathes 10*a*, and such that the grooves 30*c* and 30*d* will not rip off the sheath 10*a* to avoid contacting the core wires 10*b*.

Figure 3:
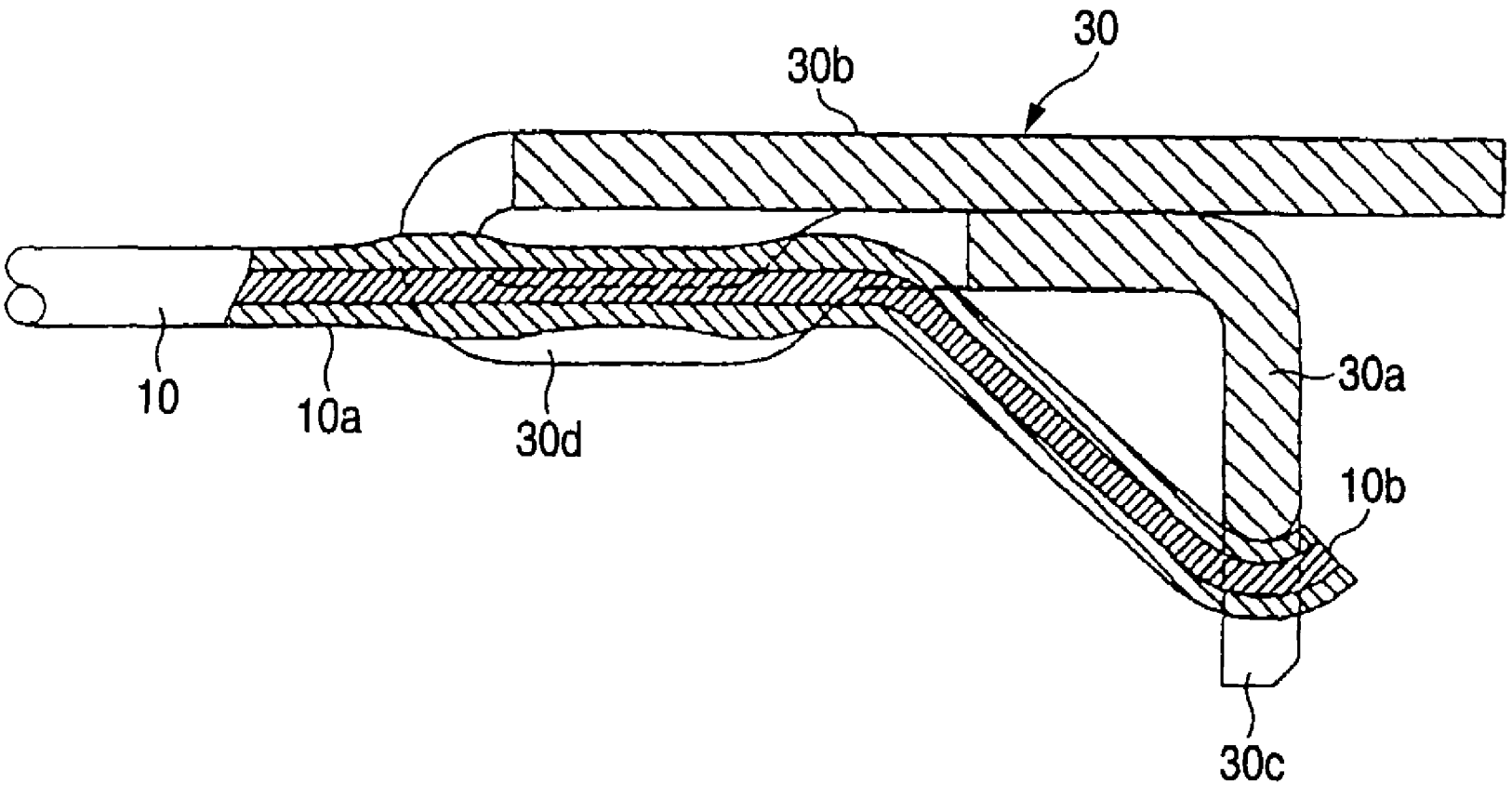
FIG. 3 is a section view taken along a line III-III of FIG. 1, showing a state that sheathed wires are attached to the pressing member of FIG. 2A.

As shown in FIG. 3, the pressing member 30 is formed by folding a conductive plate in two along a fold line extending in the direction that the sheathed wires 10 are arranged, and by bending one of the folded sections perpendicularly. The vertically-extending portion 30*a* is formed by the bent part, and the laterally-extending portion 30*b* is formed by the remaining section of the conductive plate. The grooves 30*c* are formed at the tip end of the bent part, and the grooves 30*d* are formed in one end of the laterally-extending portion 30*b* so as to include the fold line.

Figure 4:
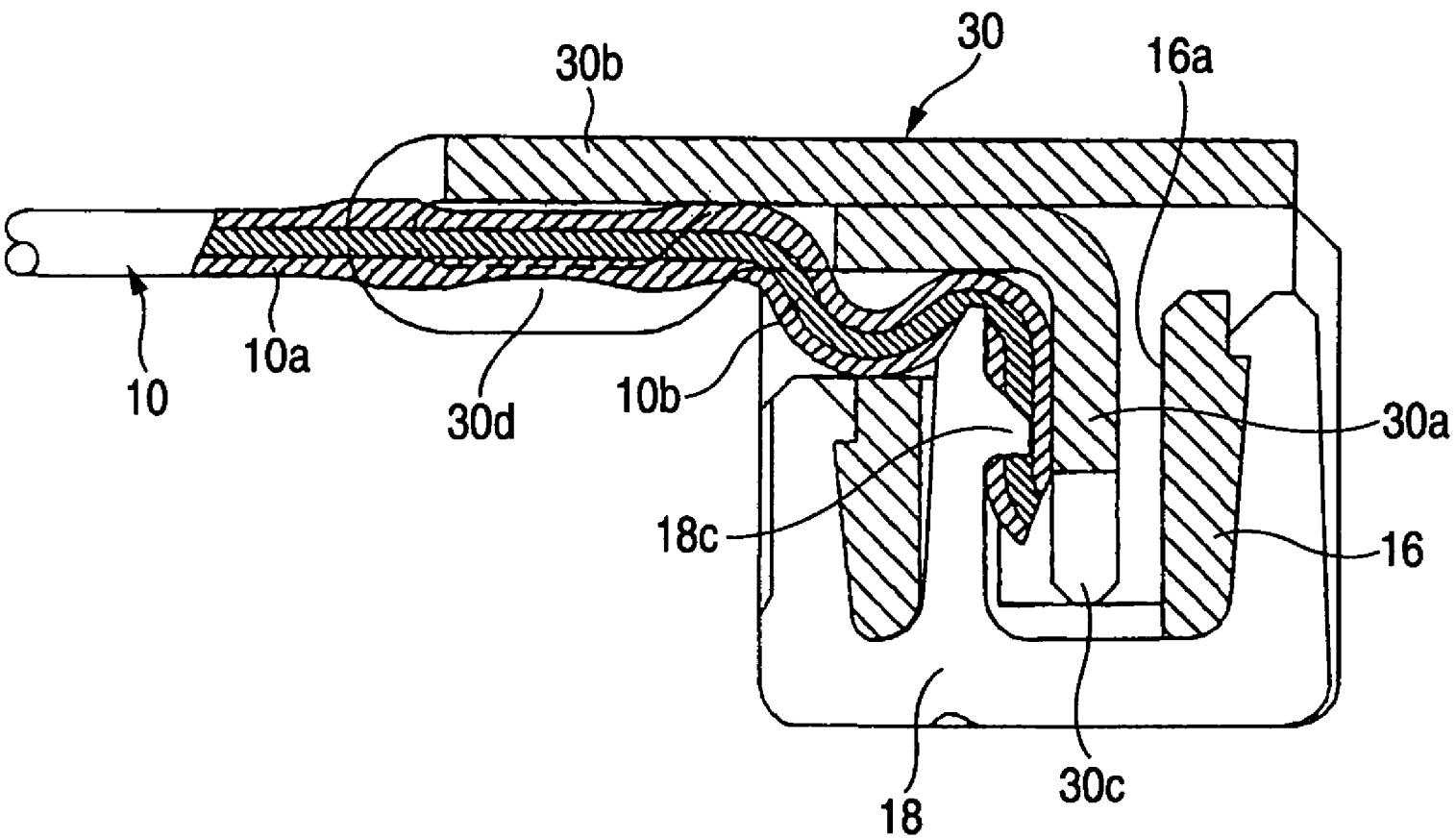
FIG. 4 is a section view of the plug body of FIG. 1, showing a state that the sheathed wires and the pressing member are attached.

The tip ends of the sheathed wires 10 are inserted into the grooves 30*c* of the vertically-extending portion 30*a*, and the end portions of the sheathed wires 10 continued from the tip ends are inserted into the grooves 30*d* of the laterally-extending portion 30*b*. As a result, the positions of the sheathed wires 10 are determined by the grooves 30*c* and 30*d* of the pressing member 30, thus completing the arrangement work. When the vertically-extending portion 30*a* of the pressing member 30 where the sheathed wires 10 are arranged and attached is inserted from the upper side to the groove 16*a* of the plug body 16, the end portions of the sheathed wires 10 are forcibly pressed against the blade portion 18*c* of the plug contacts 18 as shown in FIG. 4. As a result, the blade portion 18*c* sticks through the insulative material 10*a* so that the sheathed wires 10 are electrically connected to the core wires 10*b*.

With this configuration, a work for arranging the sheathed wires 10 side by side with a fixed pitch can be performed by merely inserting the sheathed wires 10 to the grooves 30*c* and 30*d* of the pressing member 30. Therefore, it is not necessary to perform a separate arrangement work using an arrangement member in advance as in the related-art. Consequently, it is possible to reduce labor efforts. In addition, since the arrangement member is not used, it is possible to reduce the number of components.

Figure 5:
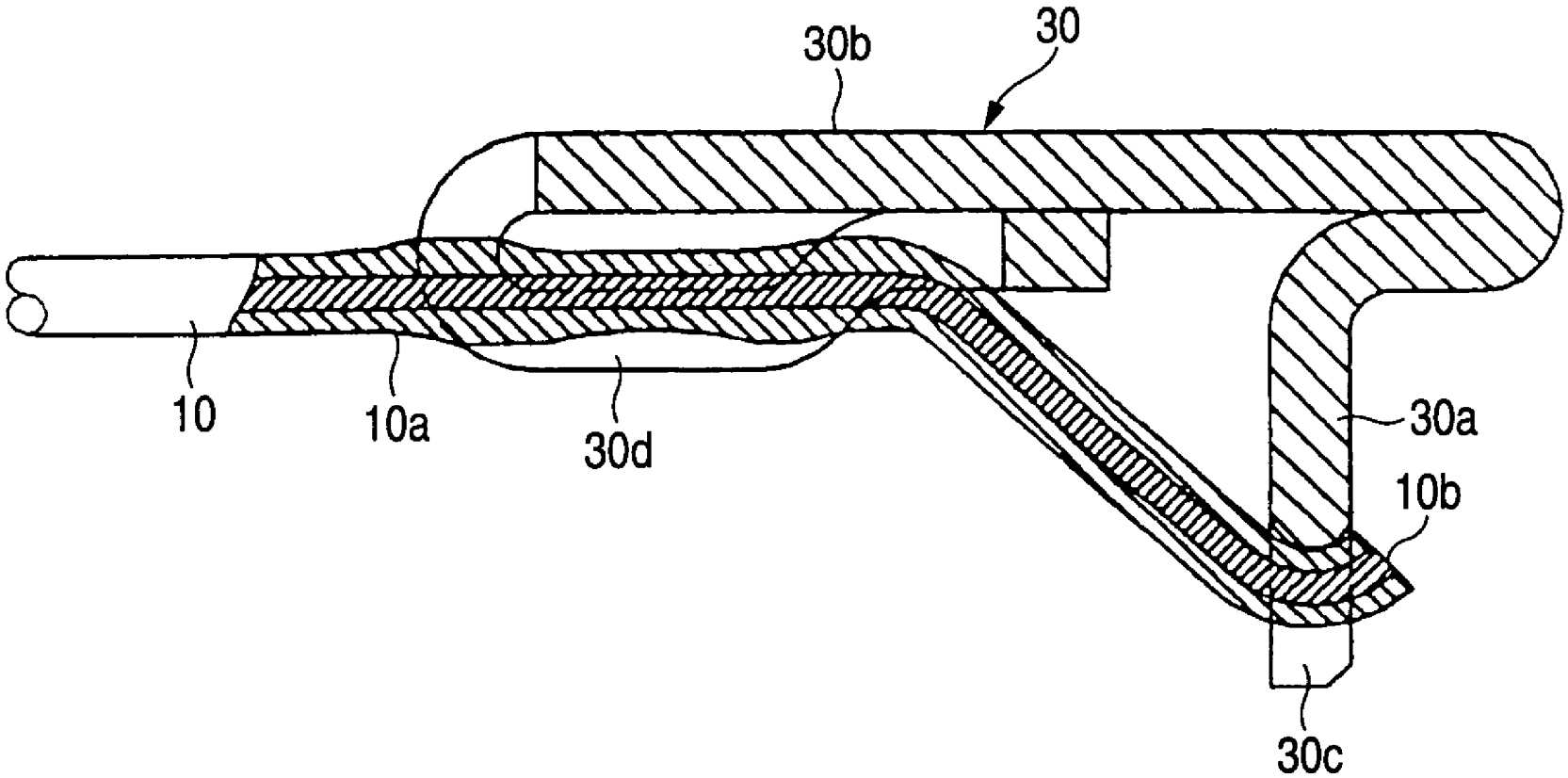
FIG. 5 is a section view of a pressing member according to a modified example of the first embodiment, showing a state that sheathed wires are attached.

FIG. 5 shows a modified example of the first embodiment. In this example, both ends of a conductive plate are folded along a fold line extending in the direction that the sheathed wires 10 are arranged so as to allow both ends to oppose each other. The vertically-extending portion 30*a* is formed by bending one end of the conductive plate, and the laterally-extending portion 30*b* is formed by the remaining section of the conductive plate.

Figure 6:
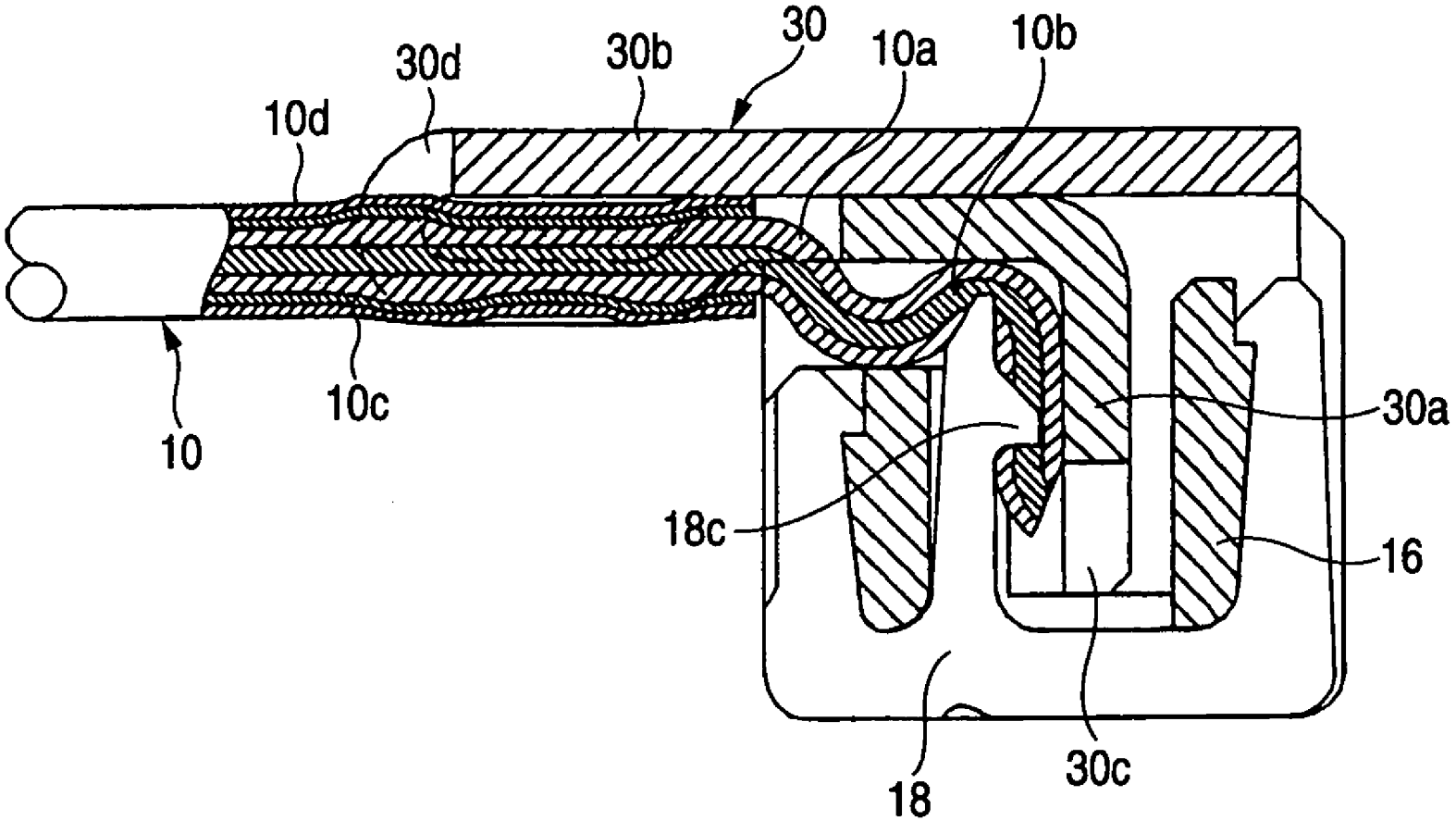
FIG. 6 is a section view of a plug body of an electric connector according to a second embodiment, showing a state that sheathed wires and a pressing member are attached.
Figure 7:
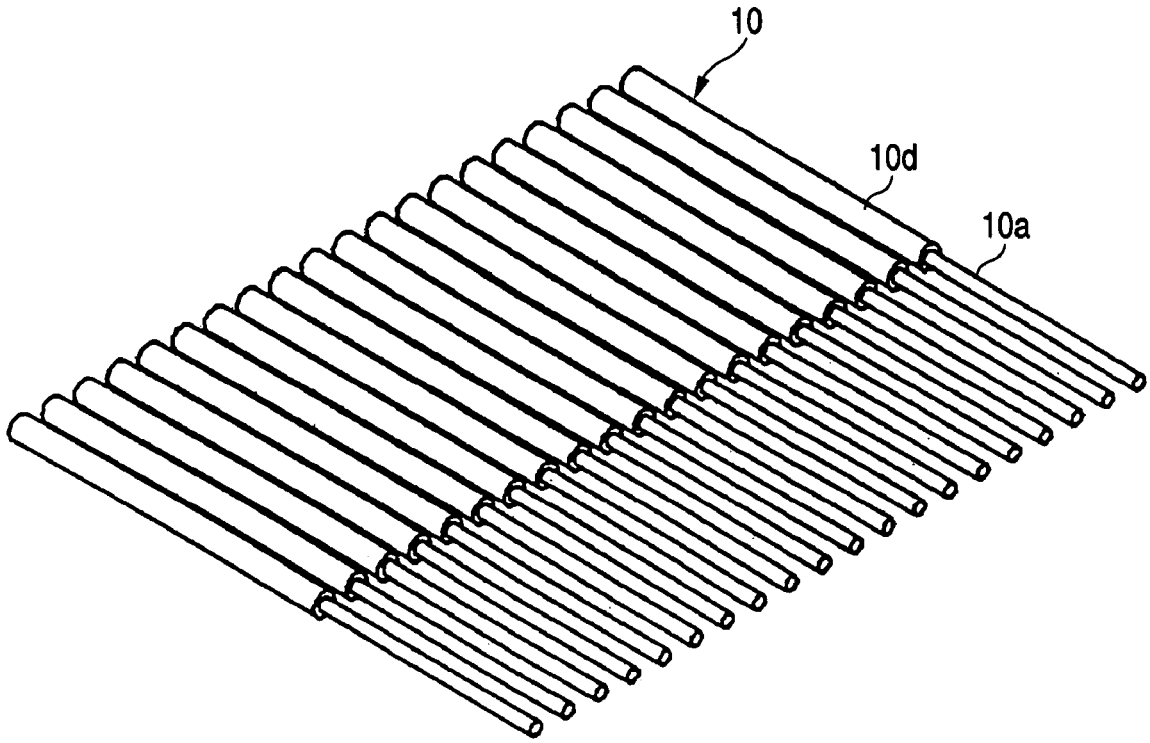
FIG. 7 is a perspective view of the sheathed wires of FIG. 6.
Figure 8:
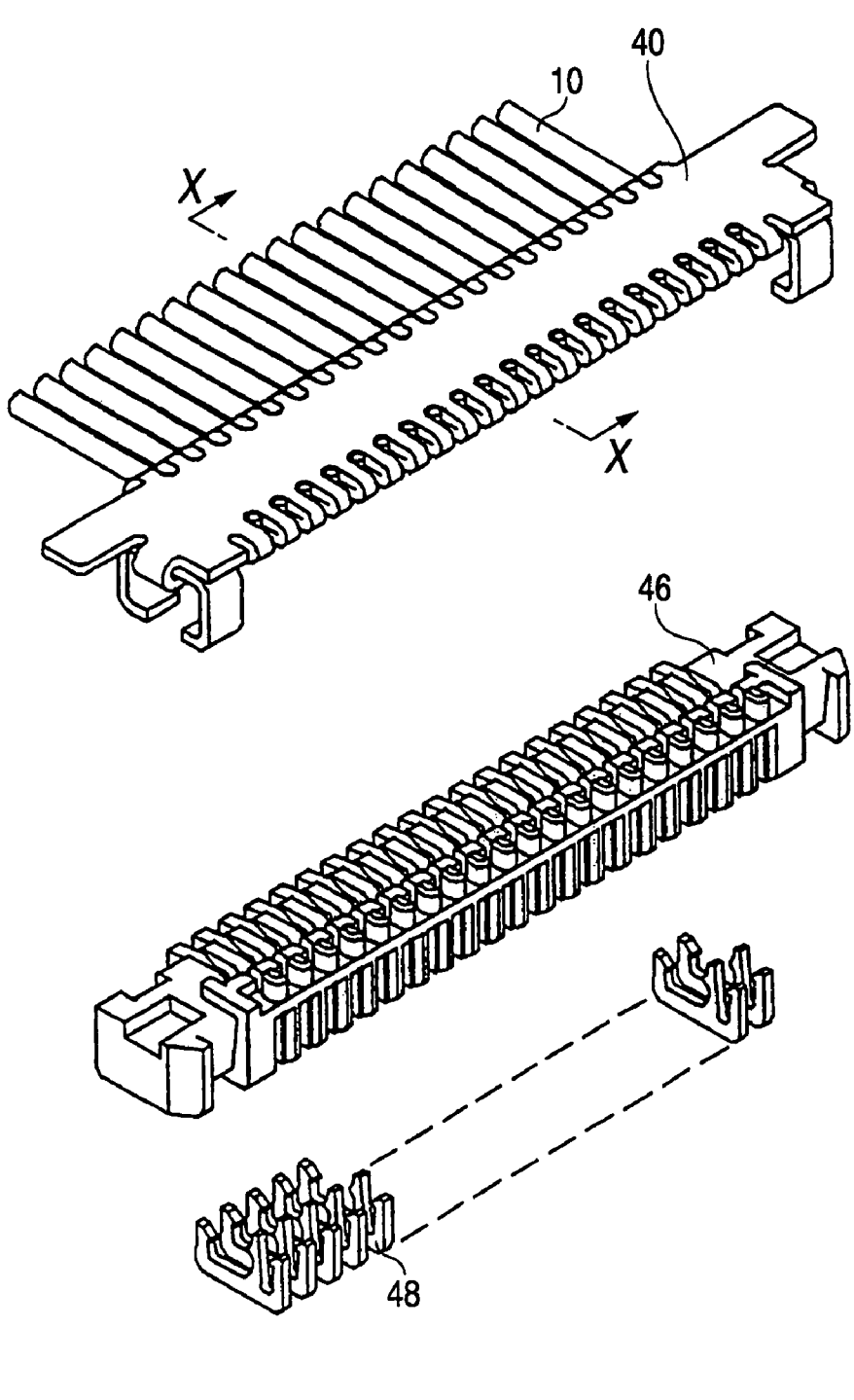
FIG. 8 is a perspective view of a plug member of an electric connector according to a third embodiment, showing a disassembled state.
Figure 9A:
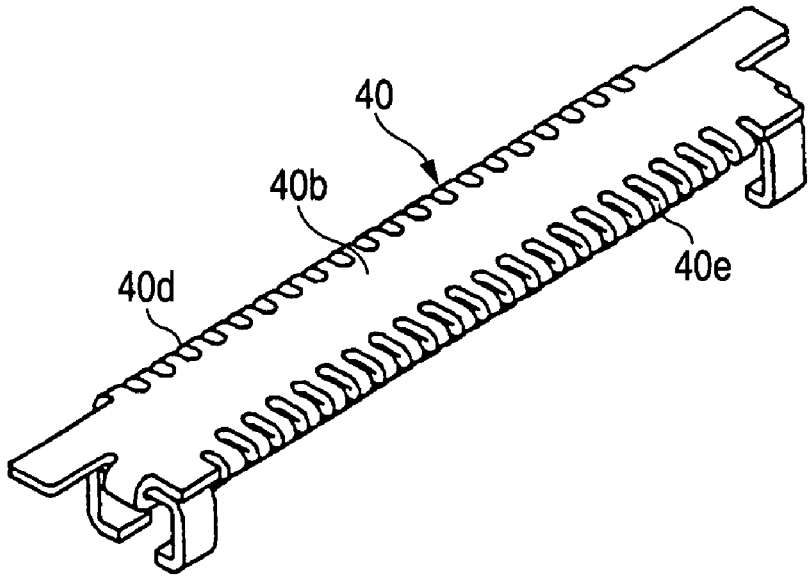
FIG. 9A is a perspective view of the pressing member of FIG. 8, viewed from an upper side.
Figure 9B:
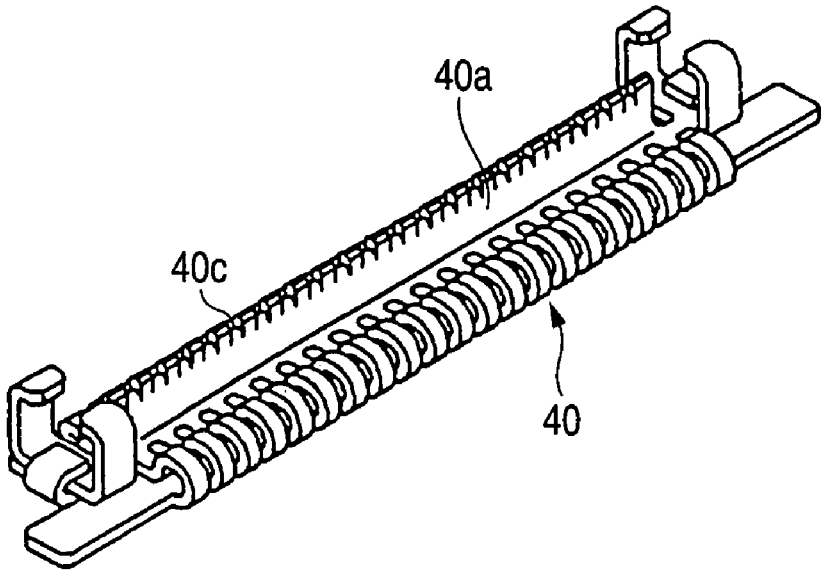
FIG. 9B is a perspective view of the pressing member of FIG. 9A, viewed from a lower side.

Next, a second embodiment of the invention will be described with reference to FIGS. 6 and 7. Components similar to those in the first embodiment will be designated by the same reference numerals and repetitive explanations for those will be omitted.

In this embodiment, each of the sheathed wires 10 is provided with a shield wire 10*c*. Therefore, as shown in FIG. 7, the outer insulative sheaths 10*d* and the shield wires 10*c* are removed from the tip ends of the end portions of the sheathed wires 10 in order to expose the insulative sheaths 10*a* of the core wires 10*b*. Then, the tip ends of the end portions of the sheathed wires 10 of which the insulative sheaths 10*a* are exposed are inserted into the grooves 30*c* of the vertically-extending portion 30*a* of the pressing member 30 formed from a conductive plate, and the end portions of the sheathed wires 10 are inserted into the grooves 30*d* of the laterally-extending portion 30*b*.

The widths of the grooves 30*c* are set such that the sheathed wires 10 can be inserted thereto by slightly deforming the sheathes 10*a*, and such that the grooves 30*c* will not rip off the sheath 10*a* to avoid contacting the core wires 10*b*. On the other hand, the widths of the grooves 30*d* are set such that they can make contact with the shield wires 10*c* by cutting the outer insulative sheaths 10*d* when the sheathed wires 10 are inserted. After the and portions of the sheathed wires 10 provided with the shield wires 10*c* are attached to the pressing member 30, the vertically-extending portion 30*a* of the pressing member 30 is inserted into the groove 16*a* of the plug body 16.

With this configuration, the shield wires 10*c* can be electrically connected to the pressing member 30 by merely inserting the sheathed wires 10 into the grooves 30*d* of the laterally-extending portion 30*b* of the pressing member 30. Then, the shield wires 10*c* of the sheathed wires 10 can be easily grounded by electrically connecting the pressing member 30 to a ground terminal or the like of the circuit board. Similar to the first embodiment, the blade portions 18*c* make contact with the core wires 10*b* of the sheathed wires 10, and the plug contacts 18 are electrically connected to the core wires 10*b*.

Next, a third embodiment of the invention will be described with reference to FIGS. 8 through 11. Components similar to those in the above embodiments will be designated by the same reference numerals and repetitive explanations for those will be omitted.

Figure 10:
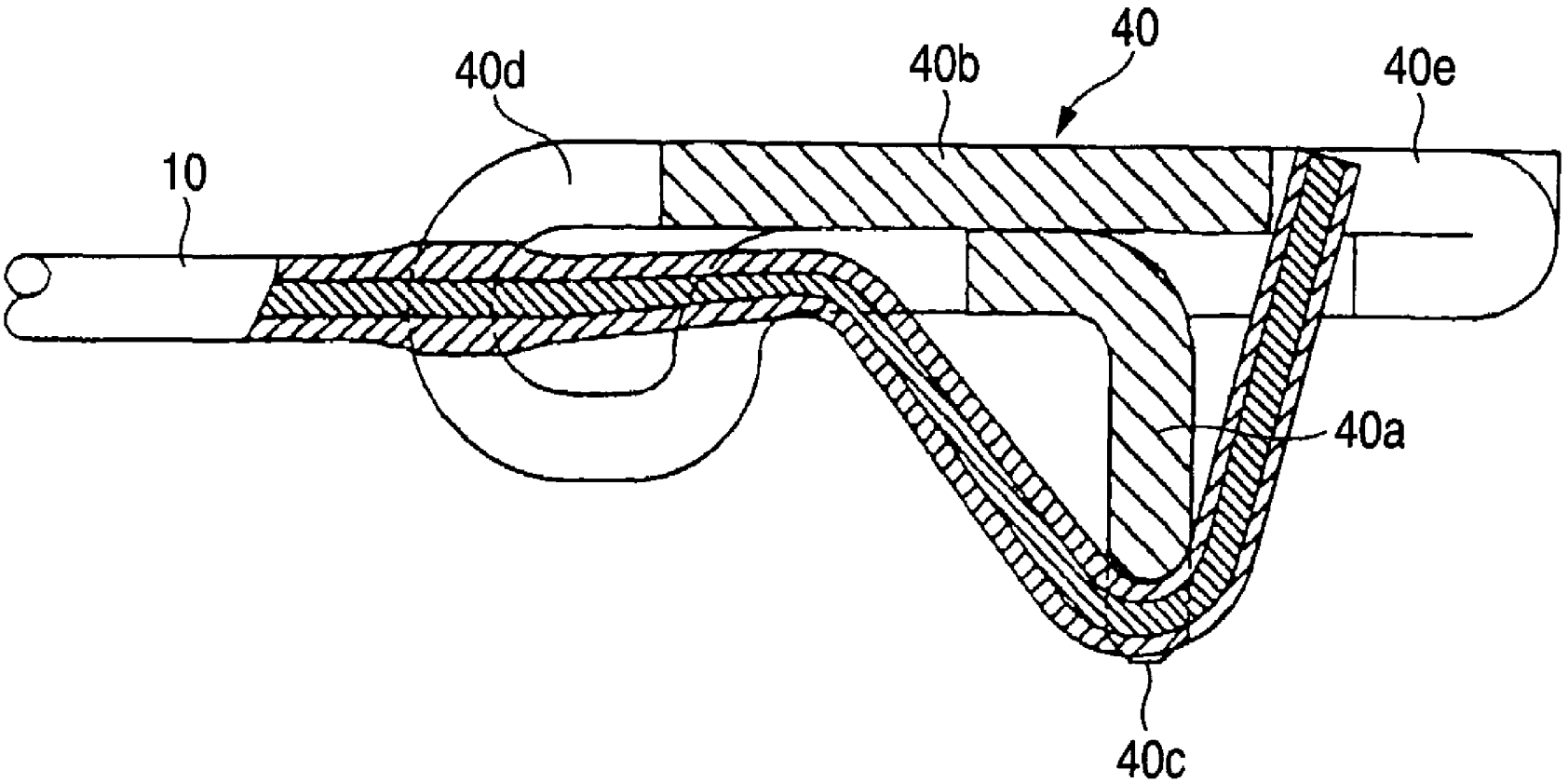
FIG. 10 is a section view taken along a line X-X of FIG. 8, showing a state that sheathed wires are attached to the pressing member of FIG. 9A.

In this embodiment, as shown in FIG. 10, a pressing member 40 is formed by folding a conductive plate in two along a first fold line extending in the direction that the sheathed wires 10 are arranged, folding a tip end portion of one of the folded sections in two along a second fold line extending in the direction that the sheathed wires 10 are arranged, and bending the other one of the folded section perpendicularly. The bent part forms a vertically-extending portion 40*a*, and the remaining section of the conductive plate forms a laterally-extending portion 40*b*. Grooves 40*c* are formed in the tip end of the vertically-extending portion

40*a*. Grooves 40*d* are formed in one end of the laterally-extending portion 40*b* so as to include the first fold line. Groove 40*e* are formed in the other end of the laterally-extending portion 40*b* so as to include the second fold line. Similar to the first embodiment, the plug body 46 is provided with a groove 46*a* extending in the direction that the sheathed wires 10 are arranged, and the plug contacts 48 are arranged side by side with a fixed pitch. The plug contact 48 is formed from a conductive plate so as to have a W-shape including first and second U-shape portions 48*a* and 48*b* opened in its upper direction. A tip portion of one end of the first U-shape portion 48*a* (i.e., the central vertical portion of the W-shape) is provided with a blade portion 48*c* protruded toward the outside of the U-shape (i.e., toward the inside of the second U-shape portion 48*b*). The plug contact 48 is installed such that: the second U-shape portion 48*b* opposes the groove 46*a*; the blade portion 48*c* is oriented toward the inside of the groove 46*a*; and at least a part of the other end of the first U-shape portion 48*a* and at least a part of the other end of the second U-shape portion 48*b* (i.e., both outer vertical portions of the W-shape) is exposed from the outer face of the plug body 16.

Figure 11:
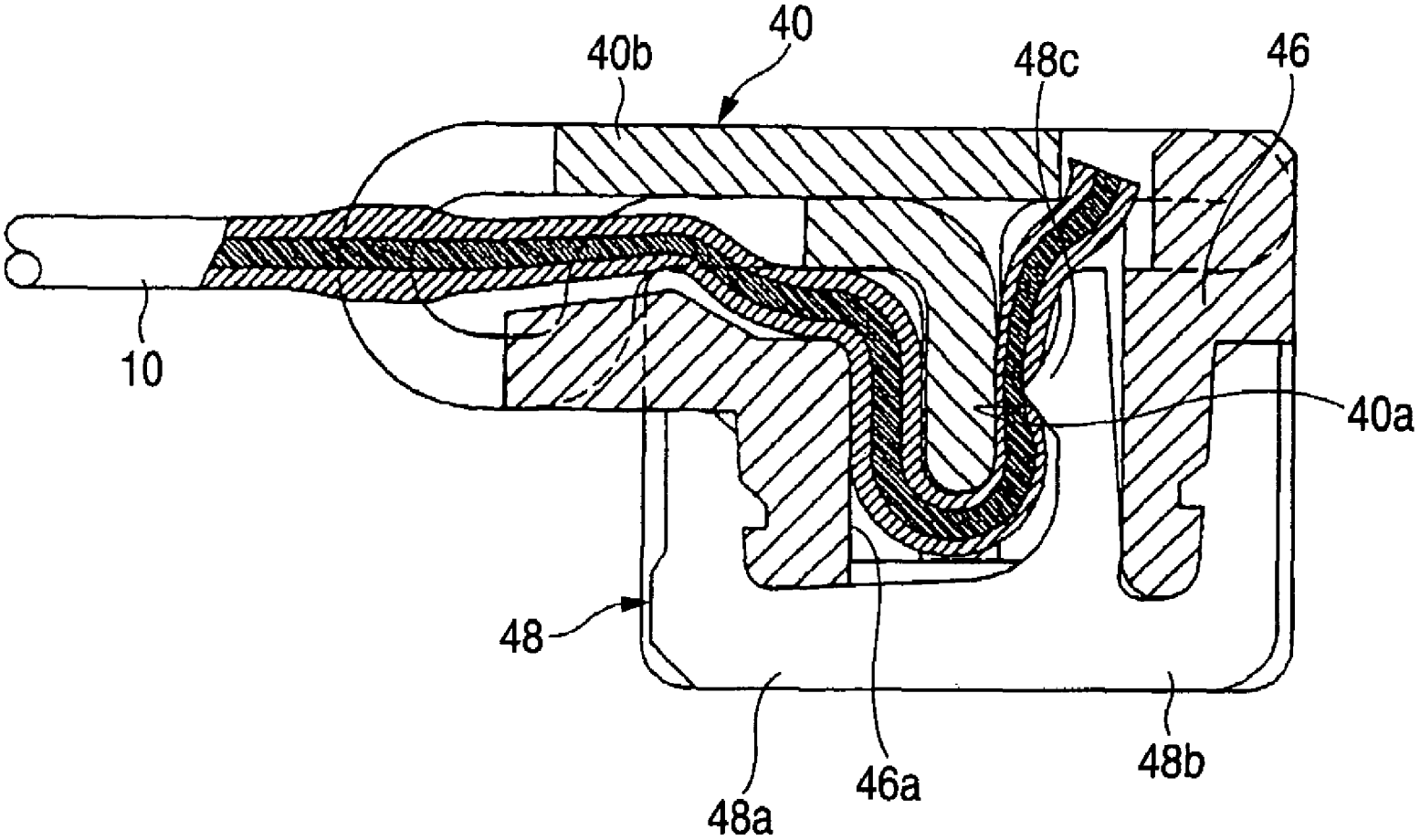
FIG. 11 is a section view of the plug body of FIG. 8, showing a state that the sheathed wires and the pressing member are attached.

As shown in FIG. 10, the end portion of the sheathed wire 10 is sequentially inserted from the tip end to the groove 40*e* formed in one end of the laterally-extending portion 40*b*, to the groove 40*c* of the vertically-extending portion 40*a*, and to the groove 40*d* formed in the other end of the laterally-extending portion 40*b*. Then, the positions of the sheathed wires 10 with respect to the pressing member 40 are determined in three points to complete the arrangement work. When the vertically-extending portion 40*a* of the pressing member 40 to which the sheathed wires 10 are attached is inserted into the upper side of the groove 46*a* of the plug body 46, the end portion of the sheathed wire 10 is bent in a U-shape by the vertically-extending portion 40*a* as shown in FIG. 11. The end portion of the sheathed wire 10 is interposed between the vertically-extending portion 40*a* and the blade portion 48*c* of the plug contact 48. The blade portion 48*c* sticks through the insulative sheath 10*a* of the sheathed wires 10, so as to electrically connect to the core wires 10*b*.

With this configuration, the arrangement work is performed by merely inserting the sheathed wires 10 to the grooves 40*c*, 40*d* and 40*e* of the pressing member 40, and the positions are determined in three points, thus providing reliable arrangement. Since the sheathed wires 10 are bent in a U-shape inside the opening 46*a*, the sheathed wires 10 can be strongly pressed by the vertically-extending portion 40*a* or the edge of the groove 46*a* of the plug body 46. Since a strong contact friction resistance is exerted against a pulling-out force, the pulling-out can be reliably prevented.

Figure 12:
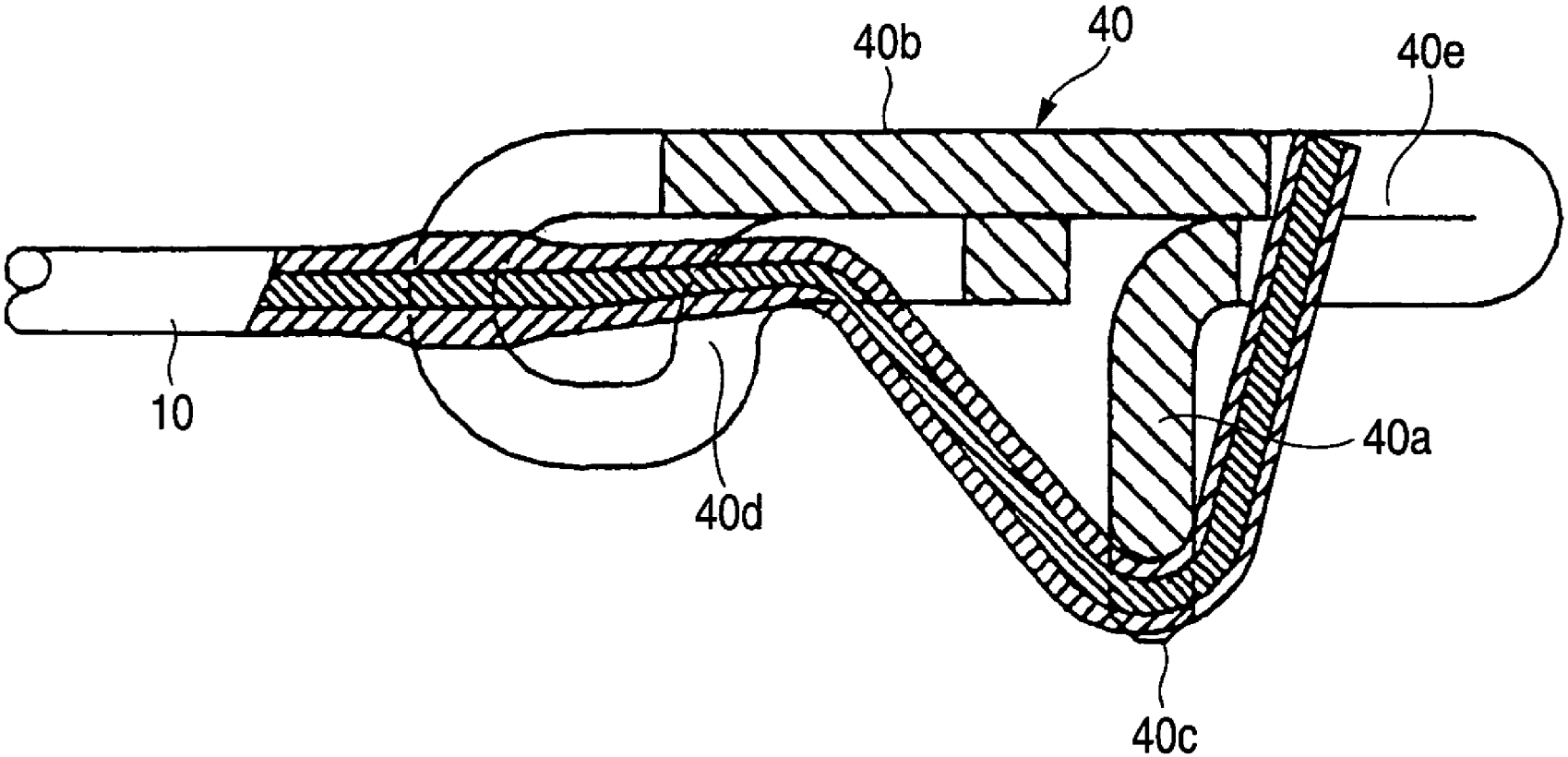
FIG. 12 is a section view of a pressing member according to a first modified example of the third embodiment, showing a state that sheathed wires are attached.

FIG. 12 shows a first modification of the third embodiment. In this example, similar to the third embodiment, the pressing member 40 is formed by folding both ends of a conductive plate along a fold line extending in the direction that the sheathed wires 10 are arranged to allow both ends to oppose each other. However, the end bent to form the vertically-extending portion 40*a* is different from that of FIG. 10.

Figure 13:
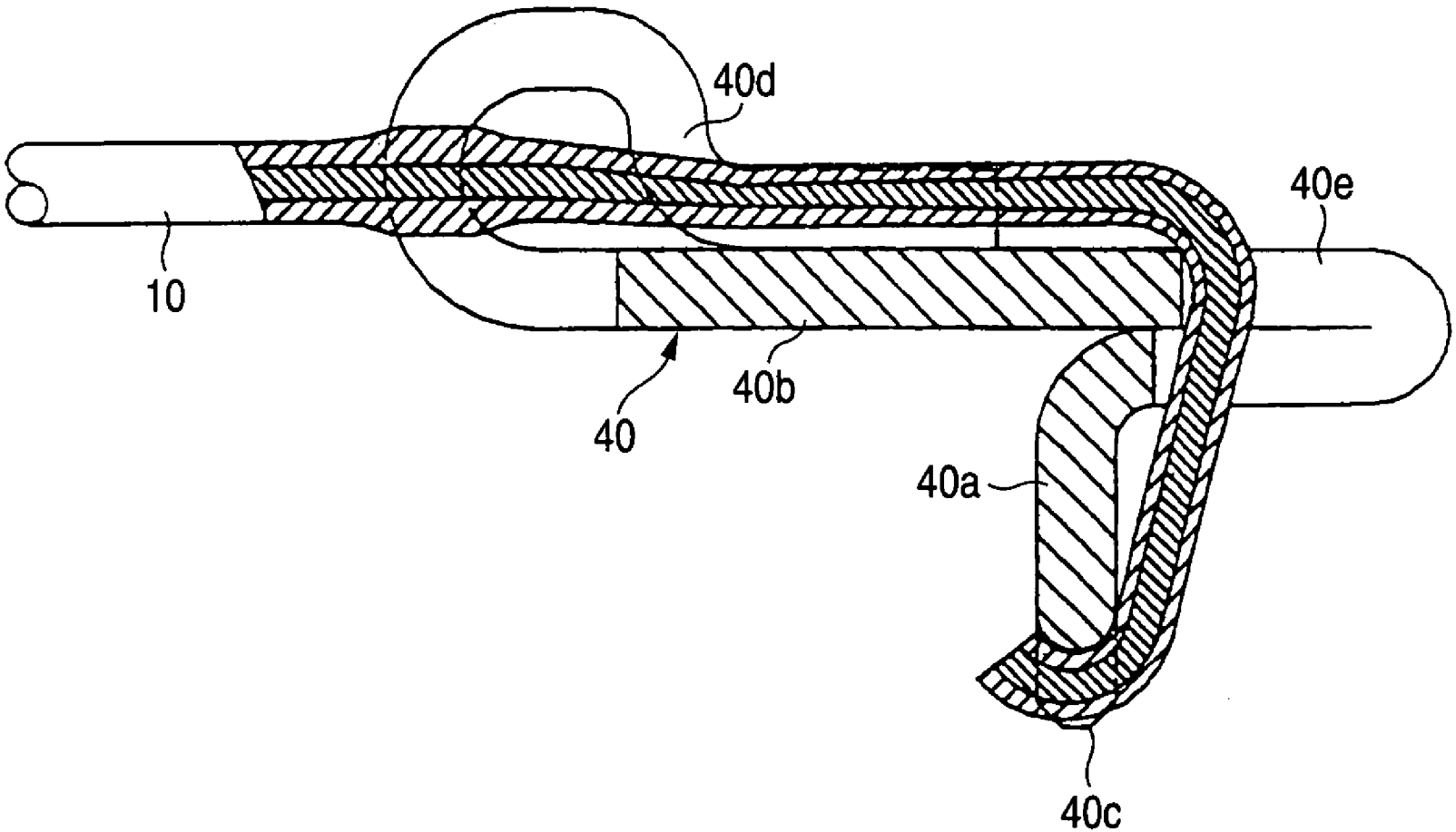
FIG. 13 is a section view of a pressing member according to a second modified example of the third embodiment, showing a state that sheathed wires are attached.
Figure 14:
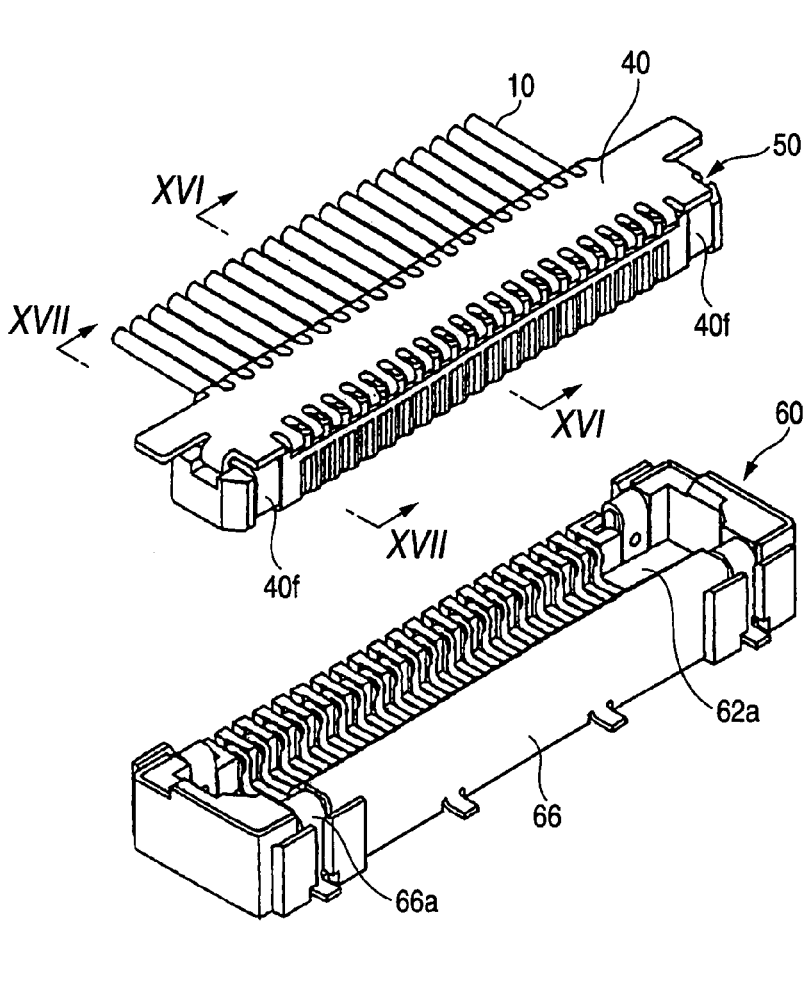
FIG. 14 is a section view of a plug body of an electric connector according to a fourth embodiment, showing a state that sheathed wires and a pressing member are attached.
Figure 15:
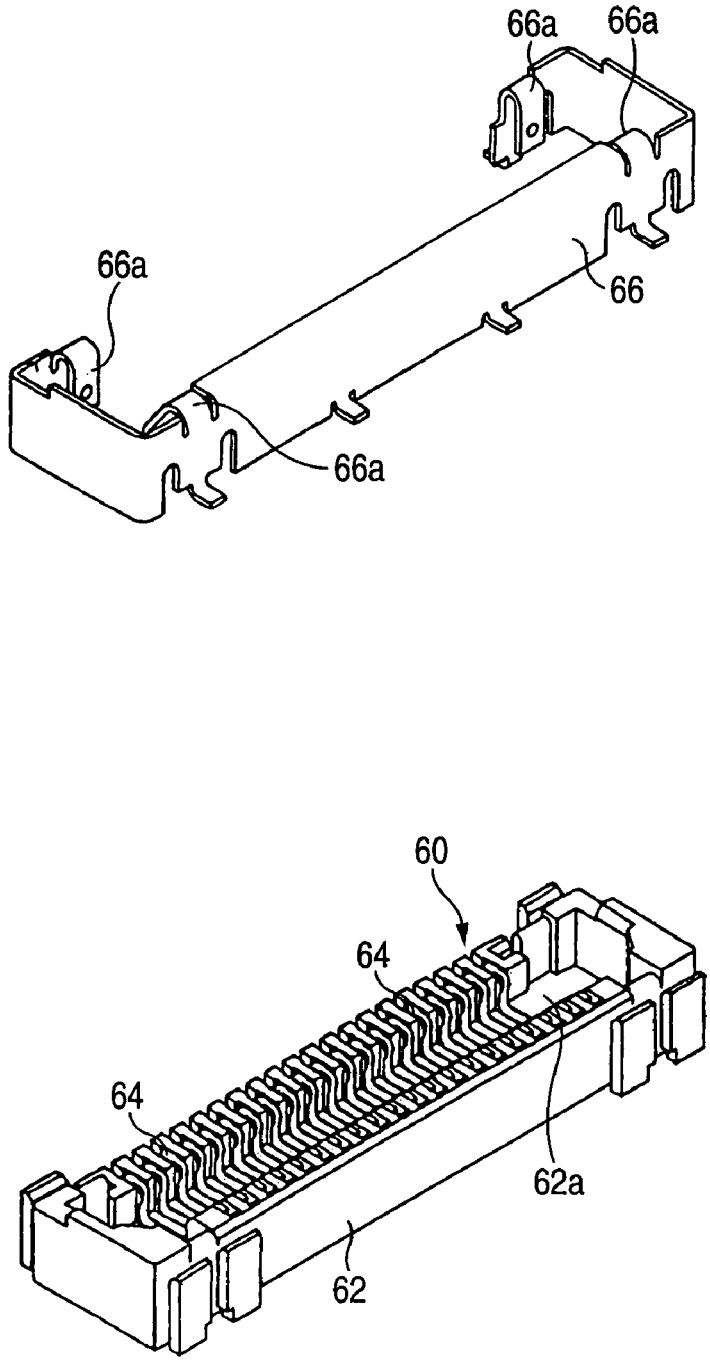
FIG. 15 is a perspective view of a socket member of the electric connector of FIG. 14, showing a disassembled state.

FIG. 13 shows a second modification of the third embodiment. In this example, the pressing member 40 is formed by folding both ends of a conductive plate along a fold line extending in the direction that the sheathed wires 10 are arranged such that the both ends are directed opposite sides. One of the ends is perpendicularly bent to form the vertically-extending portion 40*a*. The end portion of the sheathed wire 10 is sequentially inserted from the tip end to the groove 40*c* of the vertically-extending portion 40*a*, to the groove 40*e* formed in one end of the laterally-extending portion 40*b*, and to the groove 40*d* formed in the other end of the laterally-extending portion 40*b*.

With this configuration, the sheathed wires 10 are led out in a horizontal direction from an upper position of the electric connector. Therefore, electric components mounted on the circuit board do not hinder the sheathed wires 10 from being led out.

Next, a fourth embodiment of the invention will be described with reference to FIGS. 14 through 18. Components similar to those in the above embodiments will be designated by the same reference numerals and repetitive explanations for those will be omitted, In this embodiment, similar to the second embodiment, the sheathed wires 10 are provided with shield wires 10*c*. Although the pressing member 40 has a same shape as the third embodiment, the widths of the grooves 40*d* are set such that they can make contact with the shield wires 10*c* by cutting the outer insulative sheaths 10*d* when the sheathed wires 10 are inserted. In addition, the pressing member 40 is provided with shield contacts 40*f*. The pressing member 40 in which the sheathed wires 10 are attached as described above is inserted into a plug member 50.

Similar to the related-art configuration, a socket member 60 comprises a socket body 62 having a groove 62*a* into which the plug member 50 is fitted and socket contacts 64 arranged in the socket body 62, The socket member 60 also includes a ground member 66 which is formed of a conductive plate and has shield contacts 66*a* adapted to make contact with the shield contacts 40*f* of the pressing member 40 to provide electric connection when the plug member 50 is fitted with the socket member 60.

Figure 16:
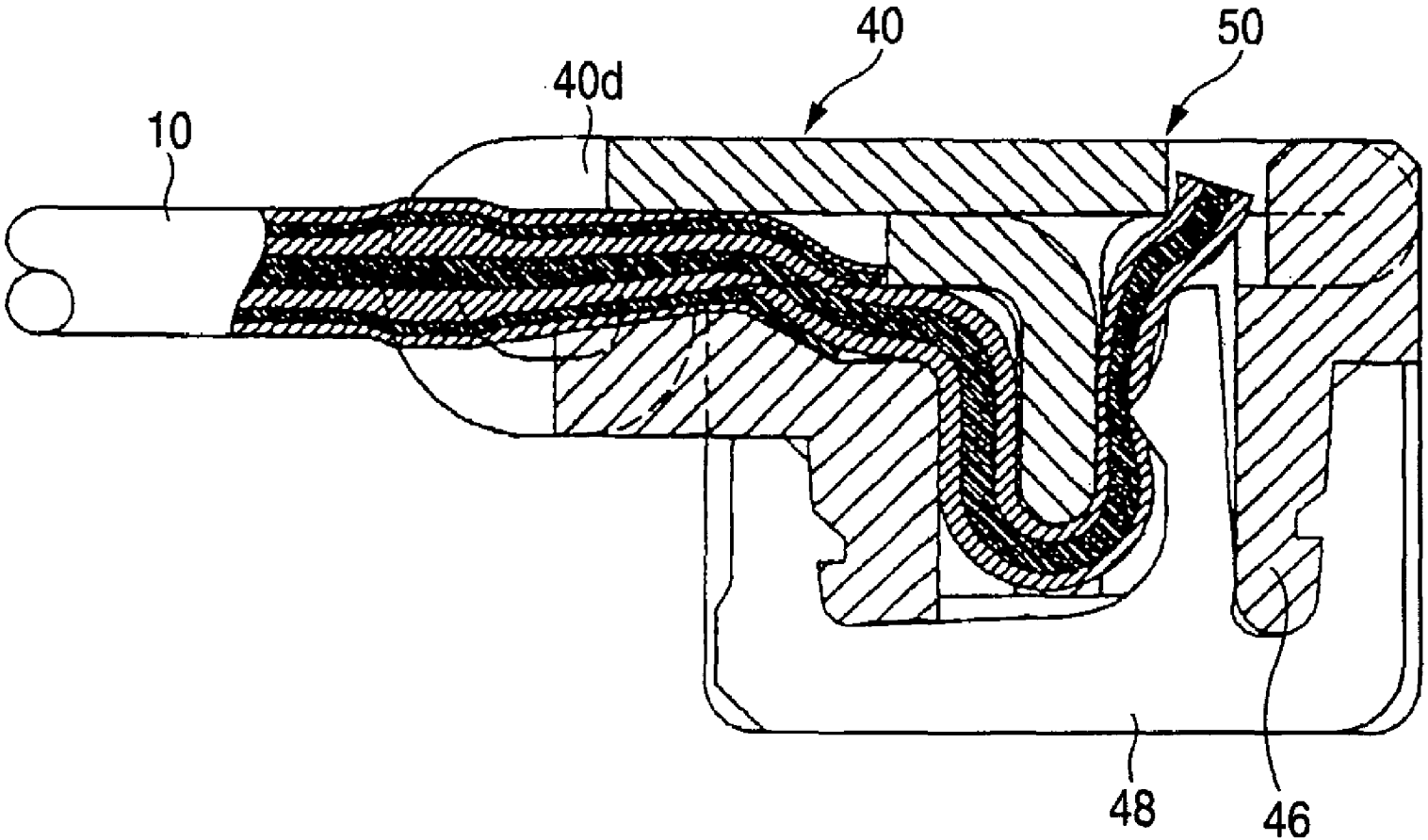
FIG. 16 is a section view of the plug body of FIG. 14, showing a state that sheathed wires and the pressing member are attached.

With this configuration, the tip end obtained by removing the outer insulative sheath 10*d* and the shield wire 10*c* from the end of the sheathed wire 10 is inserted into the groove 40*c* of the vertically-extending portion 40*a* and the groove 40*e* of the laterally-extending portion 40*b*, and the part of the sheathed wires 10 from which the outer insulative sheath 10*d* and the shield wire 10*c* are not removed is inserted into the groove 40*d* of the laterally-extending portion 40*b*. Similar to the second embodiment, the pressing member 40 is electrically connected to the shield wires 10*c* using the groove 40*d* of the laterally-extending portion 40*b*. Then, the pressing member 40 in which the sheathed wires 10 are attached is inserted into the groove 46*a* of the plug body 46 provided with the plug contacts 48, so that the state shown in FIG. 16 is obtained.

Figure 17:
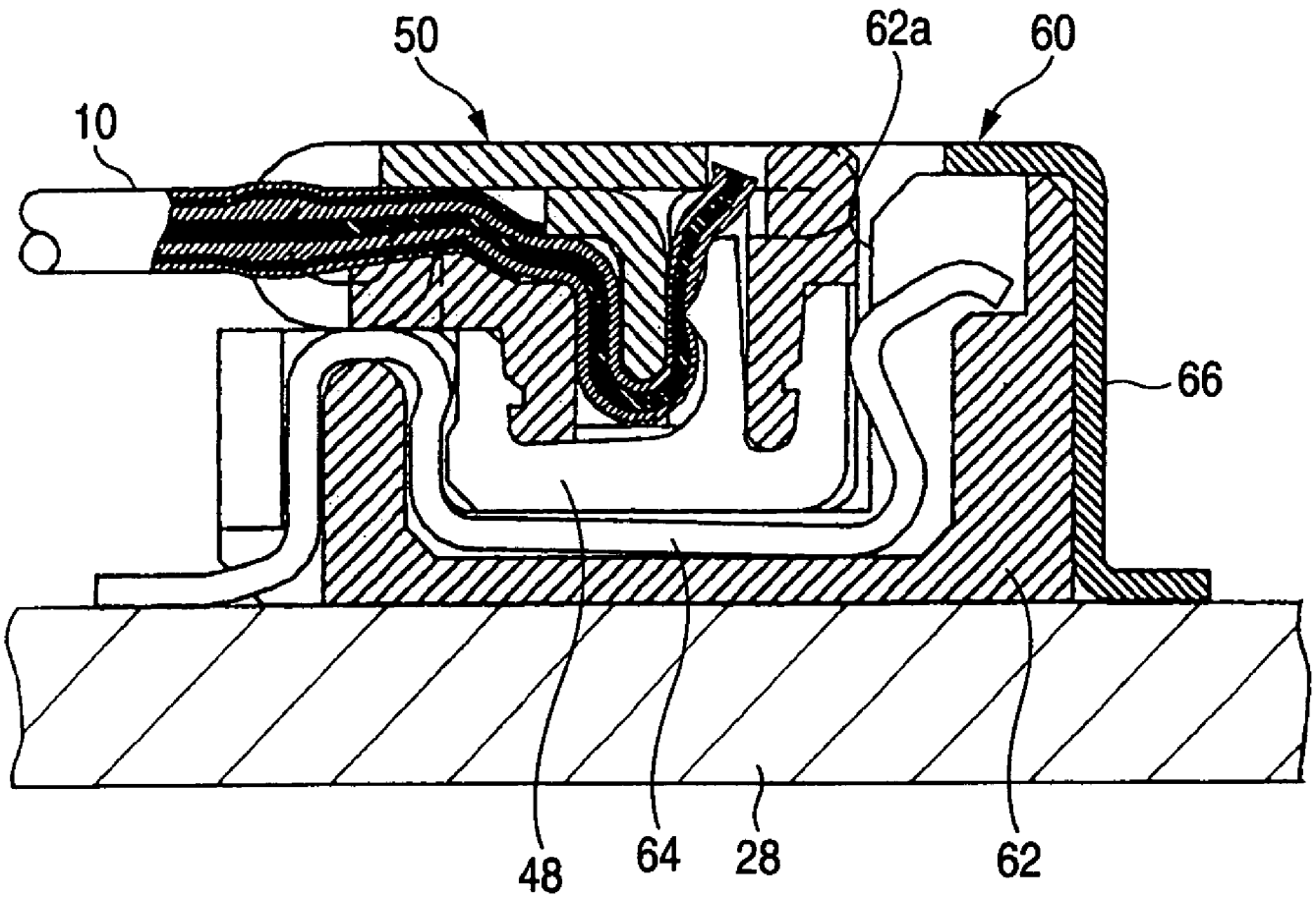
FIG. 17 is a section view taken along a line XVI-XVI of FIG. 14, showing a state that the plug member of FIG. 14 is fitted with a socket member mounted on a circuit board.
Figure 18:
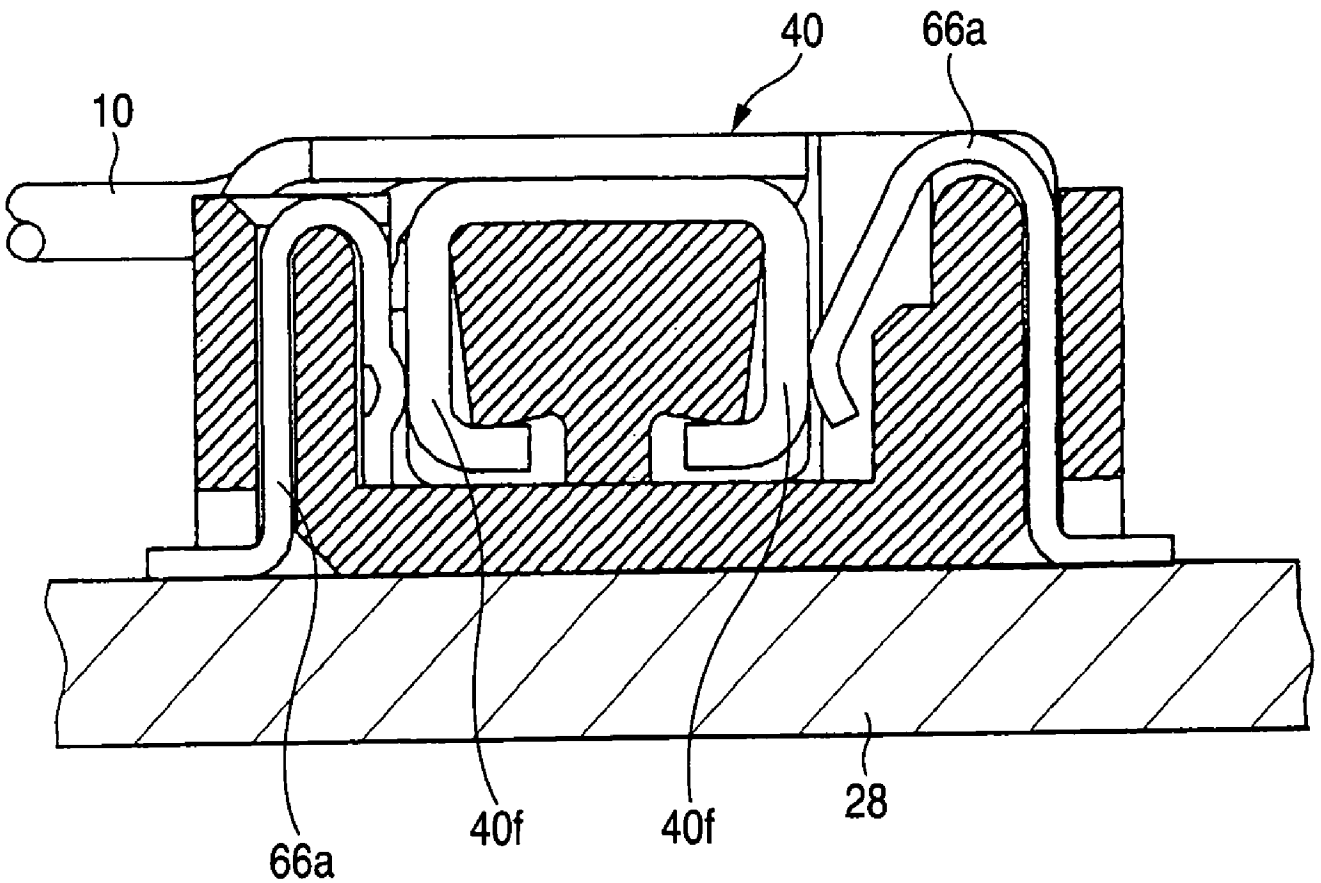
FIG. 18 is a section view taken along a line XVII-XVII of FIG. 14, showing the state shown in FIG. 17.

In addition, the plug member 50 is inserted into the groove 62*a* of the socket member 60 mounted on the circuit board 28 or the like. Here, as shown in FIG. 17, the plug contacts 48 electrically connected to the core wires 10*b* of the sheathed wires 10 make contact with the socket contacts 64 to provide electric connection, and the socket contacts 64 may be electrically connected to terminals provided on the circuit board 28 or the like. Furthermore, as shown in FIG. 18, the shield contacts 40*f* of the pressing member 40 electrically connected to the shield wires 10*c* of the sheathed wires 10 make contact with the shield contacts 66*a* of the ground member 66 to provide electric connection, and the shield contacts 66*a* can be electrically connected to a ground material provided on the circuit board 28 or the like, As a result, the core wires 10*b* and the shield wires 10*c* of the sheathed wires 10 can be simply electrically connected to the ground terminals, the ground conductors or the like provided on the circuit board 28 or the like by forming a respective electric circuit thereon.

Figure 19:
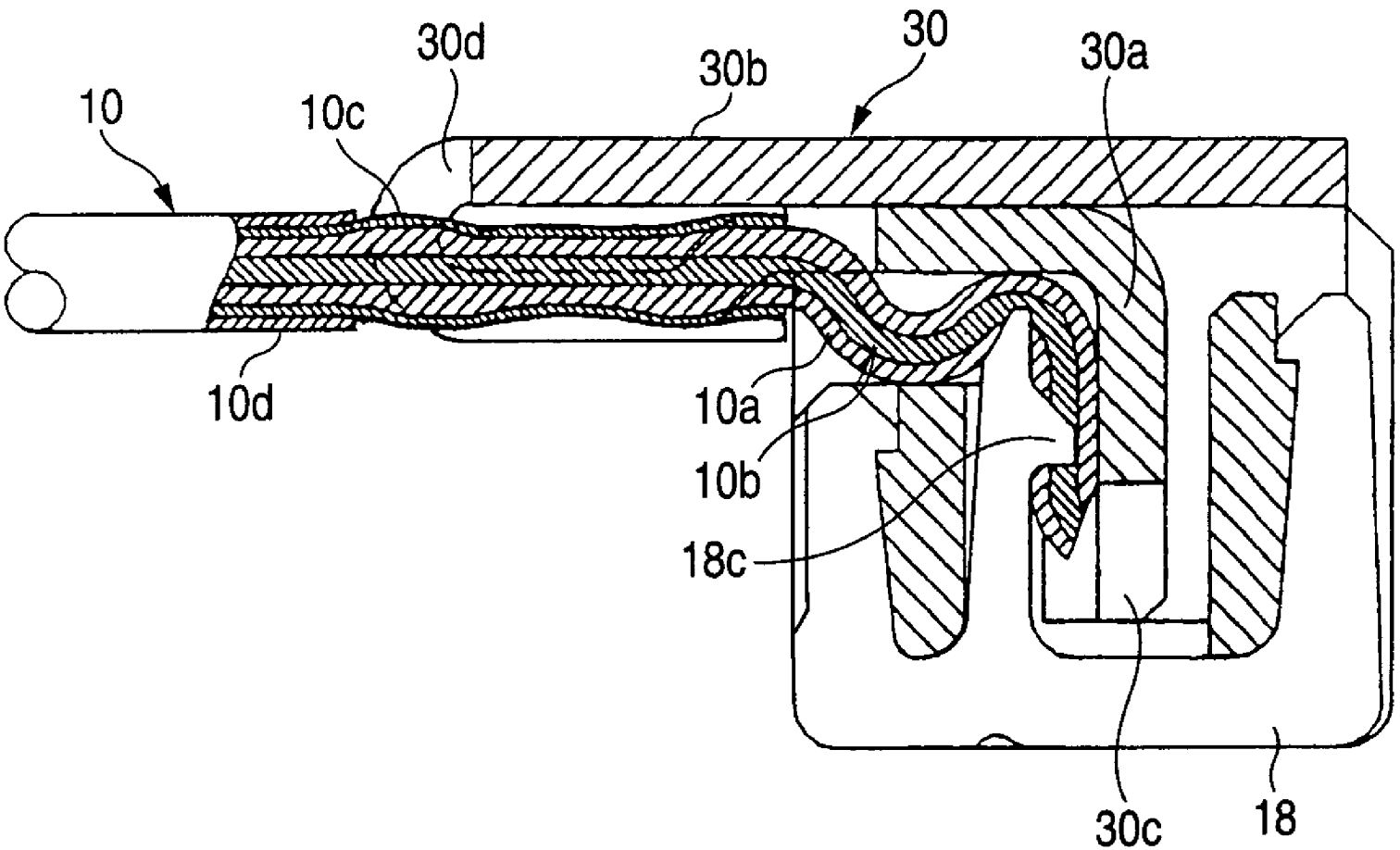
FIG. 19 is a section view of a plug body of an electric connector according to a fifth embodiment, showing a state that sheathed wires and a pressing member are attached.
Figure 20:
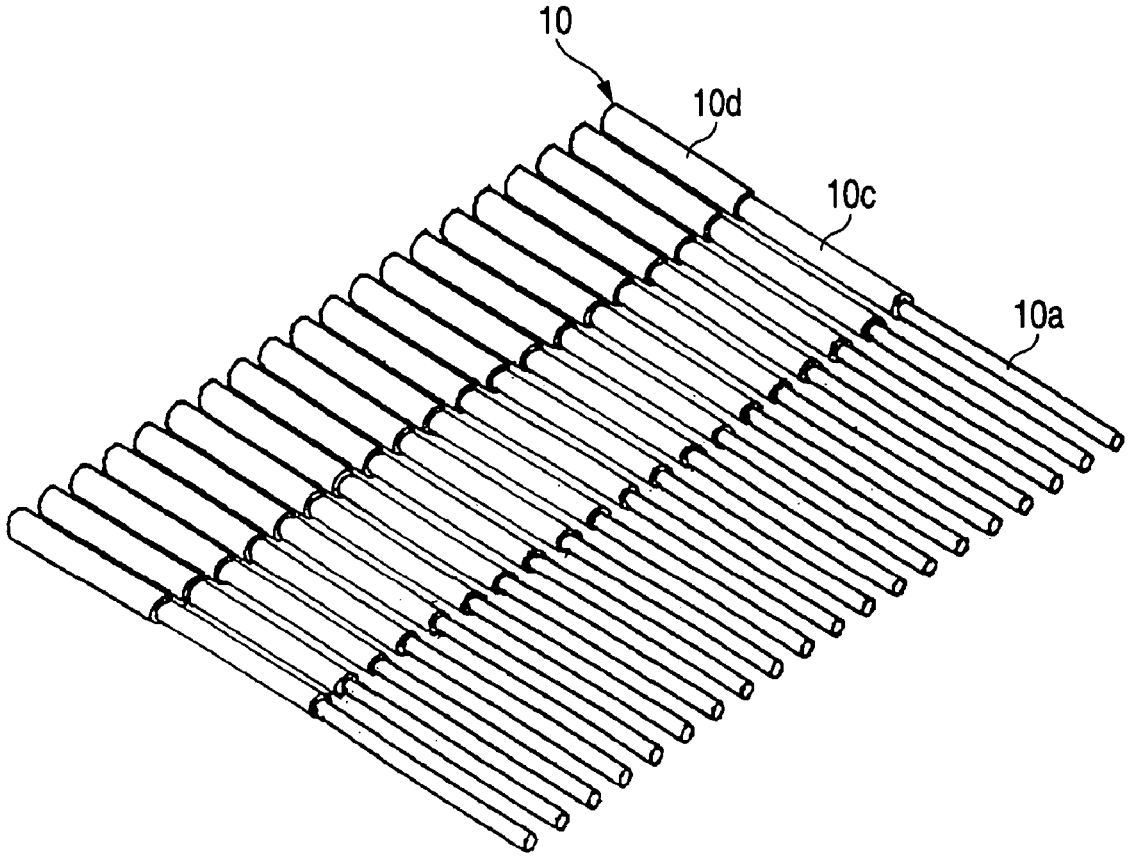
FIG. 20 is a perspective view of the sheathed wires of FIG. 19.
Figure 21:
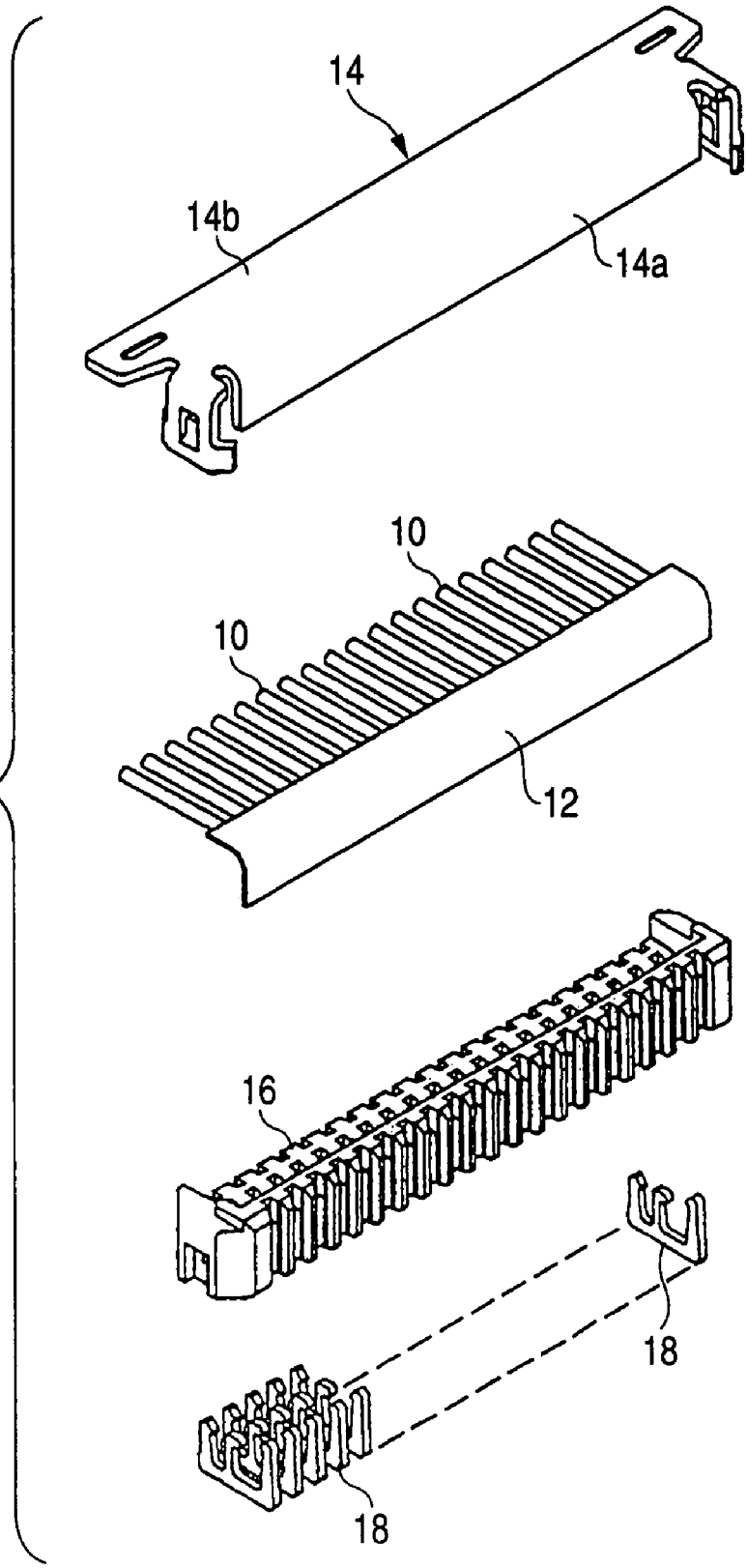
FIG. 21 is a perspective view of a plug member of a related-art electric connector, showing a disassembled state.
Figure 22:
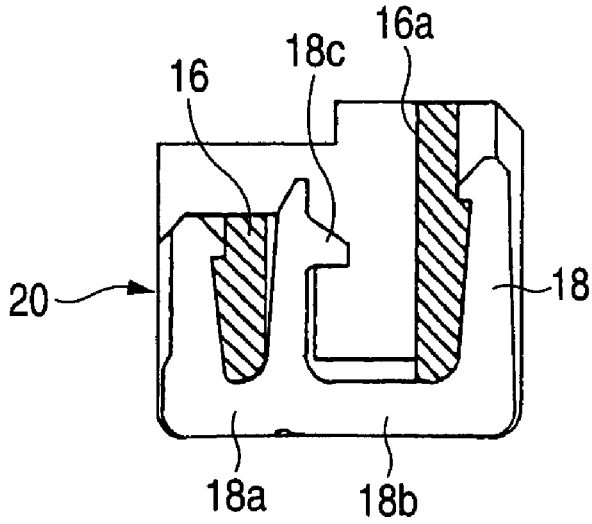
FIG. 22 is a section view of a plug body of the plug member of FIG. 21.
Figure 23:
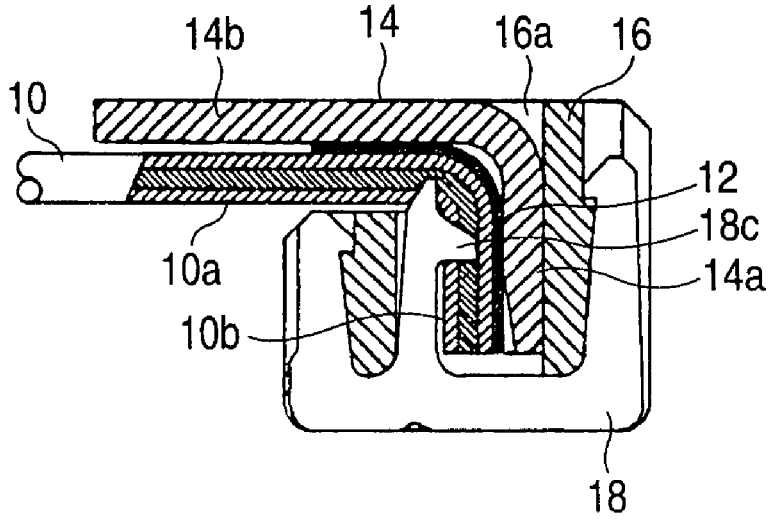
FIG. 23 is a section view of the plug body of FIG. 22, showing a state that sheathed wires and a pressing member are attached.
Figure 24:
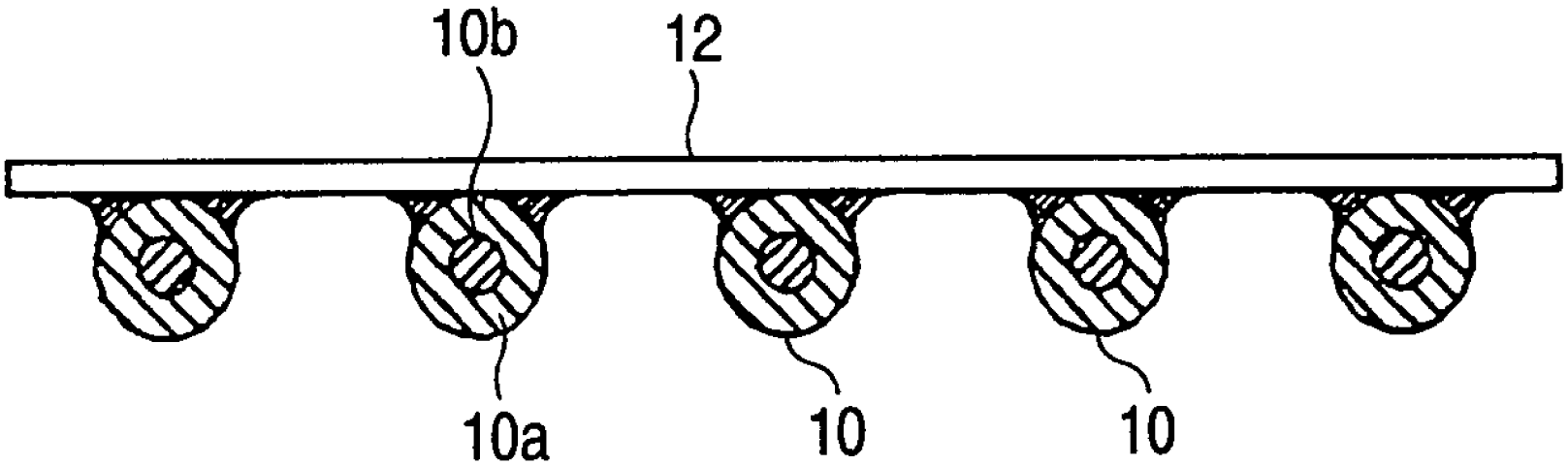
FIG. 24 is a front view showing a state that the sheathed wires are arranged on an arrangement member.
Figure 25:
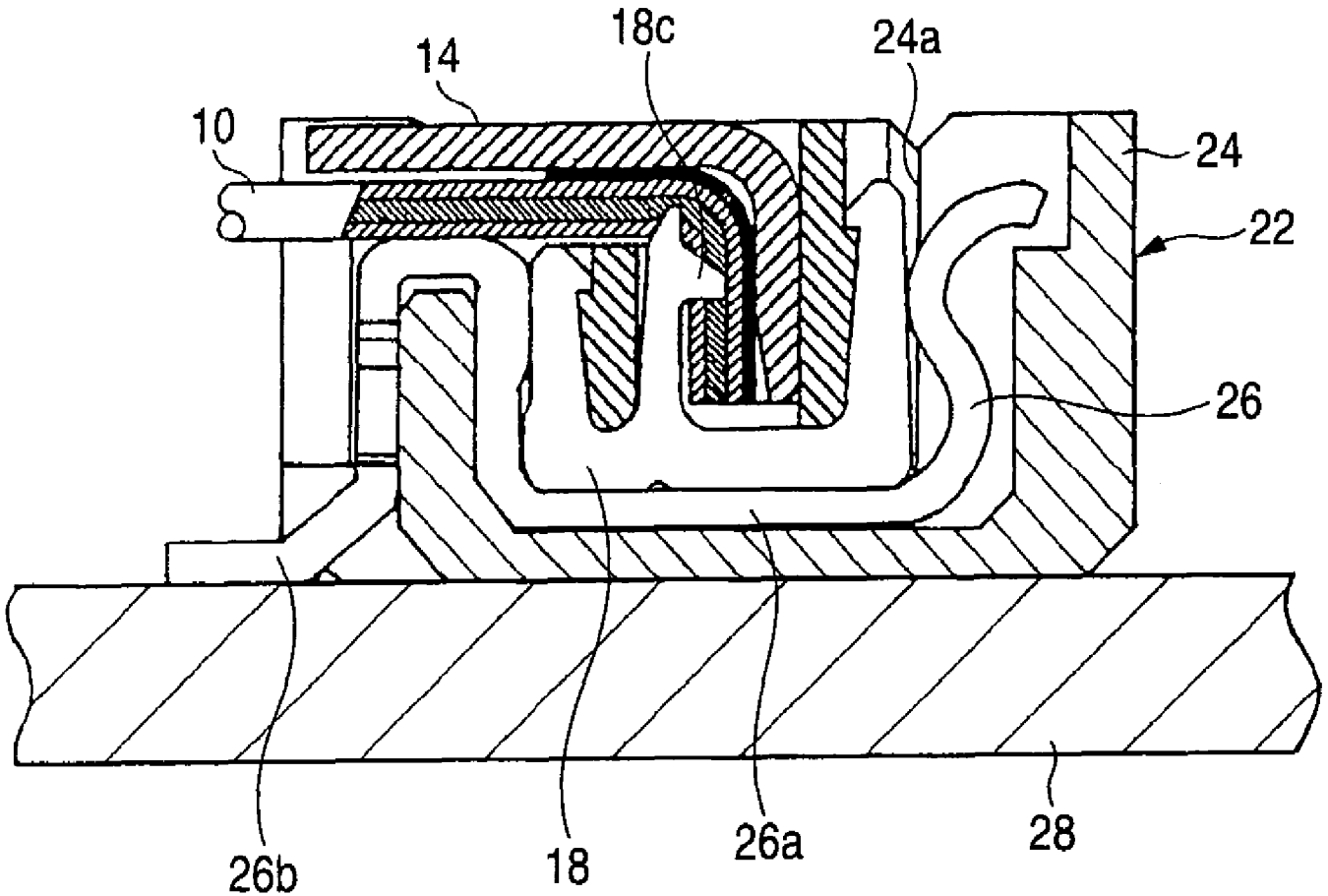
FIG. 25 is a section view of the related-art electric connector, showing a state that the plug member is fitted with a socket member mounted on a circuit board.

Next, a fifth embodiment of the invention will be described with reference to FIGS. 19 and 20. Components similar to those in the above embodiments will be designated by the same reference numerals and repetitive explanations for those will be omitted.

In this embodiment, similar to the second embodiment, the sheathed wires 10 are provided with the shield wires 10*c*. As shown in FIG. 20, the outer insulative sheath 10*d* and the shield wire 10*c* are removed from the tip end of the sheathed wire 10 to expose the insulative sheath 10*a* of the core wire 10*b*. In addition, the outer insulative sheath 10*d* of the part of the sheathed wire 10 continued from the above tip end is removed to expose the shield wire 10*c*. The tip end of the sheathed wire 10 from which the insulative sheath 10*a* is exposed is inserted into the groove 30*c* of the vertically-extending portion 30*a* of the pressing member 30 formed from a conductive plate, while the portion of the sheathed wire 10 exposing the shield wire 10*c* is inserted into the groove 30*d* of the laterally-extending portion 30*b*.

The widths of the grooves 30*c* are set such that the sheathed wires 10 can be inserted thereto by slightly deforming the sheathes 10*a*, and such that the grooves 30*c* will not rip off the sheath 10*a* to avoid contacting the core wires 10*b*. On the other hand, the widths of the grooves 30*d* are set such that they can clamp the shield wire 10*c* with a suitable strength when the sheathed wires 10 are inserted. Then, the vertically-extending portion 30*a* of the pressing member 30 to which the sheathed wires 10 are attached is inserted into the groove 16*a* of the plug body 16.

With this configuration, it is possible to establish reliable electric connection between the shield wires 10*c* and the pressing member 30. As a result, when the pressing member 30 is appropriately connected to a ground terminal or the like of a circuit board or the like, similar to the second embodiment, it is possible to easily ground the shield wires 10*c* of the sheathed wires 10.

In the above embodiments, both the plug contacts 18 and 48 have a W-shape including first and second U-shape portions. However, they may have a single U-shape if the plug contacts 18 and 48 can be stably fixed in the plug bodies 16 and 46. In addition, the U-shape portion may have a reversed C-shape opened in the left side.

In the above embodiments, the plug contacts 18 and 48 are attached to the plug bodies 16 and 46. However, the plug bodies 16 and 46 and the plug contacts 18 and 48 may be formed in a monolithic body using an insertion mold or the like. In the above embodiments, the socket contact 64 is attached to the socket body 62. However, the socket body 62 and the socket contact 64 may be formed in a monolithic body using an insertion mold or the like.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2006-105542 filed Apr. 6, 2006 including specification, drawings and claims is incorporated herein by reference in its entirety.

What is claimed is:

1. An electric connector, comprising:

a plug member, adapted to be fitted into a socket member in a first direction, the plug member comprising:

a plug body, formed with a plug groove extending in a second direction which is perpendicular to the first direction; and a plurality of plug contacts, each of which includes a first contact piece and a second contact piece which are opposed to each other with a gap therebetween, and a blade portion extended from the first contact piece so as to oppose the second contact piece, the plug contacts being arrayed in the second direction such that the first contact piece is disposed in the plug groove and the second contact piece is disposed on an outer face of a side wall of the plug body to be electrically connected with the socket body;

a pressing member, comprising a first part extending in the first direction, and a second part extending in a third direction which is orthogonal to the first direction and the second direction; and a plurality of sheathed wires, each of which comprises a conductive core wire and an insulative first sheath covering the core wire, wherein:

a tip end portion of the first part of the pressing member is formed with a plurality of first grooves arranged in the second direction;

a first end of the second part of the pressing member is formed with a plurality of second grooves arranged in the second direction;

the first part of the pressing member is inserted into the plug groove under a condition that first portions of the sheathed wires are respectively clamped by the first grooves and second portions of the sheathed wires are respectively clamped by the second grooves;

the first part of the pressing member presses each of the sheathed wires against the first contact piece in the third direction when the first part of the pressing member is inserted into the plug groove, so that the blade portion bites into the core wire in associated one of the sheathed wires; and the second part of the pressing member bents the sheathed wires so as to extend in the third direction when the first part of the pressing member is inserted into the plug groove.

2. The electric connector as set forth in claim 1, wherein:

each of the second portions of the sheathed wires comprises a conductive shield wire covering the first sheath and an insulative second sheath covering the shield wire;

edges of the second grooves bite into the shield wire when the second portions of the sheathed wires are respectively clamped by the second grooves; and the pressing member is a conductive member, and adapted to be electrically connected to a shield contact provided in the socket member when the plug member is fitted with the socket member.

3. The electric connector as set forth in claim 1, wherein:

a second end of the second part of the pressing member is formed with a plurality of third grooves arranged in the second direction; and the first part of the pressing member is inserted into the plug groove under a condition that third portions of the sheathed wires are respectively clamped by the third grooves.

* * * * *